US005572291A

United States Patent [19]

Moriguchi et al.

[11] Patent Number: 5,572,291

[45] Date of Patent: Nov. 5, 1996

[54] IMAGE FORMING METHOD, IMAGE FORMING APPARATUS AND TRANSPARENT FILM

[75] Inventors: Haruhiko Moriguchi, Yokohama; Tatsuo Takeuchi, Kawasaki; Nobuhiko Takekoshi, Tokyo; Jiro Ishizuka, Machida, all of Japan

[73] Assignee: Canon Kabushiki Kaisha, Tokyo, Japan

[21] Appl. No.: 528,525

[22] Filed: Sep. 14, 1995

Related U.S. Application Data

[63] Continuation of Ser. No. 54,132, Apr. 30, 1993, abandoned.

[30] Foreign Application Priority Data

| | | | |
|---|---|---|---|
| Apr. 30, 1992 | [JP] | Japan | 4-135627 |
| Jun. 16, 1992 | [JP] | Japan | 4-181866 |
| Jul. 24, 1992 | [JP] | Japan | 4-198677 |

[51] Int. Cl.[6] ..... G03G 15/00; G03G 13/00

[52] U.S. Cl. ..... 399/390; 428/192; 428/195; 428/914; 399/397; 430/44; 430/97

[58] Field of Search ..... 355/200, 202, 355/311, 282, 285, 289, 290, 295, 277, 278, 279, 280, 210; 503/227; 428/192, 194, 195, 323, 328, 913, 914, 204, 206; 156/235

[56] References Cited

U.S. PATENT DOCUMENTS

| | | | |
|---|---|---|---|
| 4,910,188 | 3/1990 | Akada et al. | 503/227 |
| 4,923,847 | 5/1990 | Ito et al. | 503/227 |
| 4,977,064 | 12/1990 | Sukawa et al. | 346/153.1 X |
| 5,053,382 | 10/1991 | Akada et al. | 503/227 |
| 5,130,292 | 7/1992 | Ito et al. | 503/227 |
| 5,151,313 | 9/1992 | Takeuchi et al. | 428/195 X |
| 5,156,709 | 10/1992 | Mammino et al. | 156/235 |
| 5,229,188 | 7/1993 | Takeuchi et al. | 428/195 |
| 5,260,258 | 11/1993 | Ito et al. | 428/195 X |
| 5,270,285 | 12/1993 | Ito et al. | 503/227 |
| 5,352,652 | 10/1994 | Ito et al. | 503/227 |

FOREIGN PATENT DOCUMENTS

| | | | |
|---|---|---|---|
| 403311A2 | 12/1990 | European Pat. Off. | G03G 7/00 |
| 403311A3 | 12/1990 | European Pat. Off. | G03G 7/00 |
| 430677 | 6/1991 | European Pat. Off. | G03G 15/20 |
| 0150966 | 9/1983 | Japan . | |
| 0018860 | 1/1991 | Japan . | |
| 0170944 | 7/1991 | Japan . | |

*Primary Examiner*—Matthew S. Smith

*Attorney, Agent, or Firm*—Fitzpatrick, Cella, Harper & Scinto

[57] ABSTRACT

A transparent film for forming, e.g., a toner image thereon is provided as an optically transparent sheet member having an opaque part. During the image forming, the position and conveyance state of the transparent film are detected optically by utilizing the opaque part. After the image formation, the opaque part is cleared by (i) detaching the opaque part under heating, or (ii) clarifying the opaque part by heating and/or light illumination. Accordingly, the opaque part required for image forming does not adversely affect the final transparent film product, such as an overhead projection film. The clearing of the opaque part may be performed, e.g., along with the fixation of the toner image onto the transparent film.

197 Claims, 20 Drawing Sheets

IMAGE FORMING METHOD, IMAGE FORMING APPARATUS AND TRANSPARENT FILM

This application is a continuation of application Ser. No. 08/054,132 filed Apr. 30, 1993 now abandoned.

FIELD OF THE INVENTION AND RELATED ART

The present invention relates to an image forming method and image forming apparatus for forming an image on a transparent film as a transparent recording medium to be reproduced by projection using an overhead projector by image forming apparatus according to, e.g., electrophotography, electrostatic recording, and thermal transfer recording, and also a transparent film for use therein. More particularly, the present invention relates to an image forming method and an image forming apparatus for forming an image on a transparent film having an opaque portion as a mark for optically detecting the position or conveyance state of the transparent film within an image forming apparatus, and also such a transparent film used therein.

It has been widely practiced to form an image on an OHP sheet by a recording apparatus according to, e.g., electrophotography, ink jetting and thermal transfer, and the importance thereof is expected to be increasing in the future.

As such an OHP sheet, a resinous sheet, such as generally 100–150 μm-thick PET (polyethylene terephthalate) film, has been frequently used, and a recorded image-holding layer may be disposed thereon as desired for improving the fixability, retentivity or resolution of the image.

It is frequently practiced to provide an opaque mark on a transparent film in advance in expectation of using an image forming apparatus for both such a transparent film and opaque recording paper so as to allow the detection of such a mark by an optical sensor for detecting the position of the transparent film in the image forming apparatus.

It is also frequently practiced to indicating an instruction for using a transparent film to users, such as a manner of insertion of the transparent film, on the transparent film with an opaque ink.

However, such an opaque mark for detecting the position of a transparent film remains as an image irrelevant to the recorded image so that it provides an extremely ugly appearance when projected by an OHP, and can also hide the recorded image when superposed on the recorded image.

In a conventional apparatus, such as an electrophotographic apparatus for forming an image on a recording medium, such as plain paper or a resin film, a jam sensor for inspecting the conveyance state of such a recording medium is disposed within the apparatus, and such a sensor is essential for early detection of jamming of a recording material to prevent the damage caused by the jamming.

Such a jam sensor can be easily composed as a combination of a mechanical lever and a photocoupler if the recording medium conveyance path is simple, e.g., approximately linear.

In recent image forming apparatus of the type described above, however, the recording medium conveyance path has become complicated for complying with down-sizing of the apparatus or requirement of multiple functions. Further, in view of diversification of recording media, there is a trend of using an optical sensor capable of directly detecting the conveyance state of a recording medium as by optical reflection from or transmittance through the recording medium from conventional mechanical sensors.

In such an optical detection system based on reflection from or transmittance through a recording medium, the detection becomes difficult for a transparent film as used for an OHP, so that it has been practiced to form an opaque mark as by printing on a part of the transparent film.

However, as is described above, such printed opaque mark on a transparent film for optically detecting the conveyance state of the film is also projected to provide an ugly projection image and poses a restriction that it is actually impossible to form an image in superposition of such an opaque printed mark for detection.

In contrast thereto, it has been proposed to apply a peelable opaque material as a mark for inspecting the conveyance of a transparent film at a part of the film, and peel the mark before use. According to this method, however, there is a difficulty that flexure or marring of the film can occur unless the user exercises a great care in peeling the opaque material. Further, the glue for applying the opaque material for detecting can remain on the film and provides a dirty projection image when projected by an OHP.

Now, a full-color laser printer capable of forming full-color images is explained as an example of ordinary image forming apparatus with reference to FIG. 36.

The printer includes: four image forming stations each including a charger, a developing device, a cleaning device and a scanning optical system disposed around a photosensitive drum: a transfer apparatus for moving a recording medium to the respective image forming stations and transferring toner images onto the recording medium; a paper-supplying apparatus for supplying the recording medium to the transfer apparatus; and a fixing apparatus for fixing the toner image onto the recording medium.

The respective image forming stations PM, PC, PY and PK of magenta, cyan, yellow and black, respectively, are provided with photosensitive drums 410M, 410C, 410Y and 410K, respectively, rotating in the respectively prescribed directions indicated by arrows, and also provided with chargers 411M, 411C, 411Y and 411K, scanning optical systems 412M, 412C, 412Y and 412K, developing devices 413M, 413C, 413Y and 413K, and cleaning devices 414M, 414C, 414Y and 414K, disposed around the photosensitive drums 410M, 410C, 410Y and 410K, respectively.

The transfer apparatus is constituted by an endless transfer belt 420 moving in the direction of an arrow for moving recording media S toward the photosensitive drums 410M, 410C, 410Y and 410K in the image forming stations PM, PC, PY and PK, respectively, and transfer chargers 421M, 421C, 421Y and 421K disposed below the photosensitive drums 410M, 410C, 410Y and 410K, respectively, with the transfer belt 420 disposed therebetween.

The paper supplying apparatus is constituted by a feed cassette 422, a feed-roller 423, and a register roller 424.

In operation, in the magenta image forming station PM, the photosensitive drum 410M uniformly charged by the charger 411M is exposed to image light L from the scanning optical system 412M to form an electrostatic latent image of a magenta image on the photosensitive drum 410M. The electrostatic latent image is developed with a magenta color toner by the developing device 413M to become visible as a magenta color toner image. The toner image is transferred to a transfer sheet or recording medium S on the transfer belt 420 by the transfer charger 421M, and then the residual toner on the photosensitive drum 410M after completing the transfer is cleaned by the cleaning device 414M to prepare the drum 410M for subsequent image formation.

Similarly, in the respective image forming stations PC, PY and PK of cyan, yellow and black, a cyan toner image, a yellow toner image and a black toner image are formed successively with a slight time lag therebetween on the photosensitive drums 410C, 410Y and 410K, respectively, and the toner images are successively transferred in superposition to the same transfer sheet S on the transfer belt 420 by the action of the transfer chargers 414C, 414Y and 414K, respectively.

On the other hand, transfer sheets S in the paper supplying cassette 422 are taken out one by one to be sent to the register roller 424 and conveyed onto the transfer belt 420 with positional registration and timing adjustment by the register roller 424. The transfer sheet S thus registered on the transfer belt 420 is moved by the transfer belt 420 to the photosensitive drums 410M, 410C, 410Y and 410K in the respective image forming stations PM, PC, PY and PK to receive the respective color images from the photosensitive drums 410M, 410C, 410Y and 410K, and then the transfer sheet is sent to the fixing device 430, whereby the toner images transferred in superposition are fixed.

The fixing device 430, as shown in FIG. 35, includes a fixing roller 431 and a pressure roller 432 having inside thereof halogen heaters 431*a* and 432*a*, respectively, an oil applicator 433 for applying silicone oil as a release agent onto the fixing roller, and cleaning devices 434 and 435 for removing the toner attached to the peripheries of the fixing roller 431 and the pressure roller 432.

The fixing roller 431 comprises a metal pipe surfaced with silicone rubber and fluorinated rubber. The pressure roller 432 comprises a metal roller surfaced with silicone rubber, and the surface temperature thereof is controlled at a constant temperature suitable for fixation by controlling the halogen heaters 432*a* and 432*b* by means of a thermistor 436 attached to the surface thereof and a temperature control circuit (not shown). The oil applicator 433 takes up silicone oil within an oil reservoir 433*a* and move the oil via rollers 433*b* and 433*c* to an application roller 433*a*, which is abuttable to and separatable from the fixing roller 431 and is also rotatable so as to apply the silicone oil onto the fixing roller 431. The application amount is controlled by a regulating blade 433*e*.

The cleaning devices 434 and 435 include cleaning webs 434*a* and 435*a* as cleaning members in the form of tapes, pressing rollers 434*b* and 435*b* for pressing the cleaning webs 434*a* and 434*b* against the fixing roller 431 and the pressure roller 432, feed rollers 434*c* and 435*c* for rolling out the cleaning webs 434*a* and 435*a*, and take-up rollers 434*d* and 435*d* for successively taking up the cleaning webs 434*a* and 435*a* which have decreased cleaning power and have been used up. Incidentally, the toner tends to attach onto the fixing roller 431 than to the pressure roller 432. For this reason, the cleaning web 435*a* for the pressure roller 432 is for example composed of ordinary felt of unwoven cloth of aromatic polyamideimide, whereas the cleaning web 434*a* for the fixing roller 431 is for example formed by electroplating nickel onto the side contacting the fixing roller 431 of the above-mentioned felt web so as to provide a larger cleaning ability.

Then, when the transfer sheet or recording medium S carrying a toner image T on the side facing the fixing roller 431 is conveyed to the fixing device 430, the application roller 433d of the oil applicator 433 is abutted to the fixing roller 431 to apply silicone oil thereto. While the transfer sheet S is sandwiched and passed between the fixing roller 431 and the pressure roller 432, the toner image T on the sheet S is heated and pressed to be fixed onto the sheet S through melting and attachment with solidification.

In case where an image is formed on a transparent film as a recording medium or transfer sheet S by using an image forming apparatus as described above, it is an ordinary practice that the film is detected by a mechanical, optical reflection-type or optical transmission-type sensor at the time of the film supply, and the film is detected by an optical reflection-type or optical transmission-type sensor for correction of poor conveyance during the formation of yet-unfixed images on the transfer belt since a mechanical sensor cannot be used at such time.

In case where a recording medium having a functional coating layer for high image quality or functionality only one side thereof is used, the image forming apparatus therefor is required to have a sensor for detecting the right or wrong side of the recording medium. The detection means in this case also require several sensors. If a recording medium is totally transparent in spite of the fact that such a recording medium requires various detection means as described above, it is impossible to adopt an optical sensor. In order to solve the problem, it has been also practiced to use a recording medium of an asymmetrical shape for detecting the right or wrong side, or to make an optically asymmetrical shape by printing a mark or applying paper or a film at a non-image part of a recording medium.

An example of a conventional transparent film is shown in FIG. 34. As shown in FIG. 34 the transparent film has an about 10 mm-wide printed stripe in gray at a lower part along a left side and a right part along a lower side. The printed part is designed to provide a transmittance of at most 10% in an infrared wavelength region of 800–1000 nm. Accordingly, the transparent film can be used in such a manner that one leading end has an about 10 mm-wide opaque stripe substantially not-transmitting light of 800–1000 nm so as to allow the detection of the transparent film.

For example, a case wherein a transparent film as shown in FIG. 34 is detected by a recording medium-detection means as shown in FIG. 33 will be described. The recording medium-detection means shown in FIG. 33 has a mechanical sensor 443 and an optical transmission-type sensor including a light-emitting device 444 and a light-receiving device 445. Referring to FIG. 33, when a transparent film as shown in FIG. 34 is supplied and before it reaches register rollers 446, a mechanical sensor is caused to fall by the force of conveying the recording medium whereby the supply is detected. Simultaneously therewith, the recording medium is passed between the light-emitting device 444 and the light-receiving device 445 of the transmission-type optical sensor, whereby the kind and the right or wrong side of the recording medium is detected.

For example, it is assumed that, in a normal case of conveying the transparent film, light issued from the emission device 444 and reaching the receiving device 445 is interrupted from reaching the receiving device 445 by the gray printed part of the recording medium and then the transparent film starts to allow the transmission of the light through its transparent part within a prescribed constant period. If the wrong side of the recording medium is passed through the optical sensor part, the optical interruption by the printed part is not caused but the light continually reaches the receiving device, whereby the passing of the wrong side is detected. Further, if the light is continually interrupted from reaching the receiving device 445, the medium passing is judged to be plain paper. The right or wrong side of a transparent film and the kind of a recording medium have been conventionally performed in the above-described manner.

In the above-described conventional system, however, the printed mark for judging the right or wrong side remains after the image formation, so that the handling characteristic and appearance of the image product can be impaired.

Further, transparent recording media used in an image forming apparatus as described above include, in addition the OHP, various types including a recording medium (so-called "label paper") of the type wherein a pair of films are applied with a heat-resistant adhesive so as to allow application of one film after image formation another material with the adhesive, a recording medium for electrical decoration including a semi-transparent film having an image formed thereon for illumination from a side opposite to the viewing position, and a recording medium comprising a transparent (or colored) substrate film and having thereon an image-holding layer for forming a mirror image with respect to an image to be observed so as to allow viewing from the opposite side.

In order to detect the size of such transparent recording media by an optical sensor, some special marks have been disposed depending on the size of the media. Further, in order to detect the size by only a mechanical sensor, a part of such recording media is changed into a special shape or the sensor is disposed in a number equal to the number of sizes of the recording media. Further, it has been also practiced to manually input the sizes of the recording media without using a sensor.

As described, there has been a problem that it is difficult to detect the right or wrong side and the position of such a transparent recording medium inclusive of an OHP film by optical detection means generally used for paper because of its light transmission property.

More specifically, as image formation on a transparent recording medium is performed only on one side and some recording media have a special coating on such one side, it is necessary to tell the right or wrong side of such recording media. In order to accurately maintain the alignment of image formation on a transparent recording medium or transparent film, it is necessary to supply the transparent film at an accurate timing for transferring a toner image thereto. In case where the recording medium is paper, it is unnecessary to tell the right or wrong side thereof in most cases and an optical sensor can be effectively used for positional detection taking advantage of light interruption by the paper. This is impossible for a transparent recording medium allowing light transmission. As the countermeasures, it has been practiced to form a transparent film in a laterally asymmetrical shape so as to allow detection by a mechanical sensor or dispose an optically detectable mark on a transparent film. However, such an asymmetrical shape of transparent film requires an additional processing therefor and provides a rather low detection accuracy. On the other had, the provision of an optically detectable mark provides a difficulty of leaving a mark which is rather harmful to a final product.

SUMMARY OF THE INVENTION

A generic object of the present invention is to provide an image forming method, an image forming apparatus and a transparent film having solved the above-mentioned problems.

A more specific object of the present invention is to provide an image forming method and an image forming apparatus capable of image formation on a transparent film with good positional alignment but still providing a resultant transparent film having a high-quality recorded image free from unnecessary opaque portion; and also a transparent film as a recording medium therefor.

According to the present invention, there is provided an image forming method, comprising:

providing a transparent film comprising an optically transparent sheet member having an opaque part;

optically detecting the opaque part;

forming an image on the transparent film; and clearing the opaque part by (i) detaching the opaque part under heating, or (ii) clarifying the opaque part by heating and/or light illumination.

According to another aspect of the present invention, there is provided an image forming apparatus, comprising:

detection means for optically detecting an opaque part of a transparent film comprising an optically transparent sheet member having the opaque part;

image forming means for forming an image on a surface of the transparent film; and means for clearing the opaque part by (i) detaching the opaque part under heating, or (ii) clarifying the opaque part by heating and/or light illumination.

According to still another aspect of the present invention, there is provided a transparent film, comprising: an optically transparent sheet member having an opaque part (i) to be detached under heating from the transparent sheet member, or (ii) to be clarified by heating and/or illumination.

DETAILED DESCRIPTION OF THE INVENTION

The transparent film according to the present invention comprises a transparent sheet member at least partly provided with an opaque part (mark), so that the position, the right or wrong side and the conveyance state of the film can be detected by detecting the opaque mark. Further, it is possible to provide the user with instructions, such as a manner of inserting the film, by the opaque part (mark).

After the image formation on the transparent film, the opaque part is cleared by (i) detaching the opaque part under heating, or (ii) clarifying the opaque part by heating and/or light illumination. Accordingly, the opaque part is not projected as a part of an projected image at the time of projection of the product transparent film having an image thereon.

According to a first embodiment, the transparent film according to the present invention is provided with an opaque part which can be detached under heating.

The opaque part detachable under heating of the transparent film can be composed of any opaque substance or member which can be detached under heating and can be formed on at least partially on the transparent sheet member.

For example, the opaque part may be formed by a layer of a substance, such as polyester resin, ester wax, carnauba wax or a mixture of these, having a relatively low-melting point and caused to have a low viscosity at a relatively low temperature with an organic pigment or dye dispersed therein, or by first forming a layer of such a low-melting substance and then laminating thereon a foil of a metal, such as aluminum. If a desired opaque part (mark) is disposed on a desired part by disposing such an opaque member on a transparent sheet member to form a transparent film, the position of the transparent film can be detected and instructions, such as a manner of insertion of the film, can be provided to the user.

On the other, such an opaque member is easily softened and becomes viscous on heating, so that it is transferred onto a fixing roller after image formation to be removed from the transparent sheet member. As a result, the resultant recorded image is free from such an opaque member constituting an opaque part (mark), thus providing a high-quality transparent recorded image.

Figure 1:
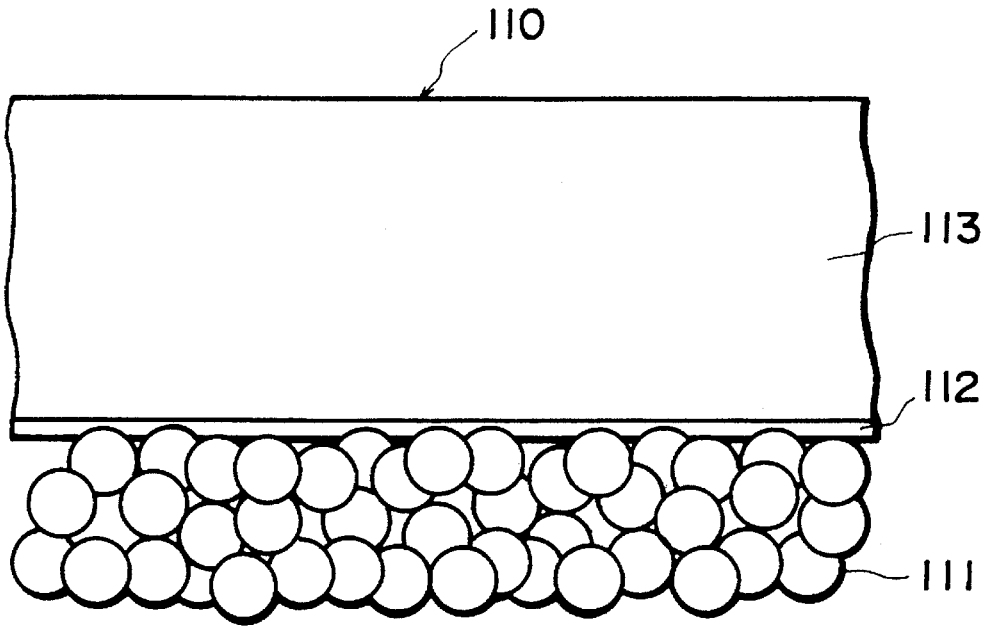
FIG. 1 is a sectional view of a transparent film according to the invention.

According to a preferred embodiment as shown in FIG. 1, a transparent film 110 may be formed by first forming an anchor coat layer 112 on a transparent sheet member 113 and then forming an opaque (sensing) mark 111.

The transparent sheet member 113 may be composed of any material, inclusive of a film or sheet of plastics, such as polyester resin, diacetate resin, triacetate resin, polystyrene resin, polyethylene resin, polycarbonate resin, polymethacrylate resin, cellophane, celluloid, polyvinyl chloride resin, and polyimide resin, or a glass sheet. The sheet member may have any thickness but may preferably have a thickness of about 1–5,000 μm, particularly 70–150 μm.

According to a preferred embodiment, the opaque mark 111 having a function of providing an increased haze value before the fixation stage may comprise a resin layer of a porous structure including internal cracks or communicating pores, which can be clarified under application of heat and/or pressure. The opaque mark 111 satisfying the characteristic may principally comprise resin particles and a binder.

Such an opaque mark 111 may generally be formed by applying an emulsion containing thermoplastic resin particles onto a desired part of a sheet member 113 of a transparent film 110 as shown in FIG. 1 and may be uniformized by melt sticking under heat and/or pressure application.

The resin particles may for example comprise one or a mixture of resins, such as polyethylene, polymethacrylate, elastomer, ethylene-vinyl acetate copolymer, styrene-acrylic copolymer, polyester, polyacrylic resin, and polyvinyl ether.

The resin particles used in the present invention are not limited to those described above but may comprise any resin which does not show a substantial adhesiveness to a recording material such as a toner for forming an image on the transparent film and can be clarified. The binder has a function of binding the resin particles mutually and/or to the sheet member, and may preferably be non-adhesive to the toner similarly as the resin particles.

The binder may comprise any known material having the above function, and preferred examples thereof may include: polyvinyl alcohol, acrylic resin, styrene-acrylic copolymer, polyvinyl acetate, ethylene-vinyl acetate copolymer, starch, polyvinyl butyral, gelatin, casein, ionomer, gum arabic, carboxymethylcellulose, polyvinylpyrrolidone, polyacryl amide, polyurethane, melamine resin, epoxy resin, styrene-butadiene rubber, urea resin, phenolic resin, α-olefin resin, chloroprene, and nitrile rubber. These resins may be used singly or in mixture of two or more species.

The opaque mark 111 can contain another additive for enhancing the above function, such as a surfactant, a fluorescent brightener, an antiseptic, an antimold, a penetrant, or a crosslinking agent.

Regarding the mixing ratio (weight ratio) between the resin particles and the binder, too much binder reduces cracks or communicating pores in the opaque mark to lower the haze value before the fixing. Too much resin particles lower the mutual adhesion between the resin particles and the adhesion between the sheet member and the resin particles, so that the opaque mark becomes liable to be peeled.

The opaque mark 111 may preferably have a thickness of 1–200 μm, particularly 3–50 μm, while it depends on the desired haze value and the apparatus conditions, such as the amount of a release agent.

The opaque mark 111 may be formed on the sheet member 113 by first forming a coating liquid by dissolving or dispersing the above-mentioned materials in an appropriate solvent, and applying the coating liquid onto the sheet member 113. In this instance, it is preferred to form in advance an anchor coat layer (adhesion-controlling layer) 112 on the sheet member 113 so as to provide an adequate adhesion between the opaque mark 111 and the sheet member 113. The application may be performed by a known method, such as roller coating, rod-bar coating or spray coating to form a layer, which may preferably be rapidly cooled.

The anchor coat layer 112 may be disposed to enhance the adhesion between the sheet member 113 and the opaque mark 111 in case where the materials of the sheet member 113 and the opaque mark 111 have rather distant solubility parameters. On the other hand, the anchor coat layer 112 may be disposed to weaken the adhesion between the sheet member 113 and the opaque mark in case where they are composed of materials having solubility parameters which are identical or too close to each other.

In the case of removal by separation of the opaque mark 111, it is preferred that an adhesion A acts between the sheet member 113 and the anchor coat layer 112, an adhesion B acts between the anchor coat layer 112 and the opaque mark 111, and an adhesion C acts between the opaque mark 111 and a member for removing the opaque mark 112 by offsetting (a pressure roller in the case of Example 4 appearing hereinafter), so as to satisfy the following condition:

adhesion A≦adhesion B<adhesion C.

Further, in case where the opaque mark is composed of the resin particles and the binder, it is preferred that an adhesion D acts between individual resin particles, so as to satisfy the following condition:

adhesion A<adhesion B<adhesion D<adhesion C.

Specific examples of resin which may constitute the anchor coat layer may include: polyvinyl alcohol, acrylic resin, styrene-acrylic copolymer, polyvinyl acetate, ethylene-vinyl acetate copolymer, starch, polyvinyl butyral, gelatin, casein, ionomer, gum arabic, carboxymethylcellulose, polyurethane, melamine resin, epoxy resin, styrene-butadiene rubber, urea resin, phenolic resin, α-olefin resin, chloroprene, and nitrile rubber. These resins may be used singly or in mixture of two or more species so as to satisfy the above conditions.

In the present invention, as the means for detaching the opaque mark 111 from the transparent film 110, it is suitable to use a fixing device most frequently used in the electrophotography apparatus, i.e., of the type using both heat and pressure, but is also possible to adopt a separate detaching means in addition to other fixing means generally suitable for fixing a toner image onto a recording medium based on pressure fixation; fixation utilizing only heat, such as hot air fixation and flash fixation; or of the type utilizing a heater and a heat-resistant belt.

In the case of using a hot-roller fixing device for fixing a toner image onto the transparent film, a pressure roller may be caused to contact the opaque mark on the transparent film while using the release agent in an amount smaller than that used in ordinary fixation to cause the opaque mark to be offset, i.e., transferred, to the pressure roller, thereby effecting the removal of the opaque mark from the transparent film.

The application amount of the release agent applied to the pressure roller for causing an offset of the opaque mark onto the pressure roller should be appropriately set depending on the materials concerned but may preferably be set to, e.g., at most 40 μg/cm$^2$, more preferably at most 20 μg/cm$^2$ in terms of the amount of the release agent applied onto the fixing roller abutted to the pressure roller in the case of using a combination of materials adopted in Example 4 described hereinafter, i.e., (i) using a pressure roller comprising an aluminum core member coated with a lower layer of HTV silicone rubber and then with a surface layer of polytetrafluoroethylene, (ii) a release agent comprising dimethylsilicone oil having a viscosity of 300 centi-stokes and (iii) an opaque mark formed by a composition A comprising emulsified thermoplastic elastomer resin/emulsified ionomer resin/sodium dioctylsulfosuccinate (mixed in ratios of 100/12/0.3), so as to provide a condition that almost no release agent is absorbed by the pressure roller.

According to a second embodiment, the transparent film according to the present invention is provided with an opaque part (mark) which can be clarified by heating.

The opaque part in this embodiment may be constituted as a random reflection layer causing random reflection of light incident thereto, which may be converted on heating into a smooth film not causing random reflection. The random reflection layer may be formed by roughening a part of the surface of the transparent sheet member.

In the case of viewing a toner image on a recording medium such as plain paper with eyes, the toner image is observed as a reflection image of light incident to the fixed toner image, so that the image quality is little affected even if the toner image retains a particulate characteristic to some extent. In the case of viewing a toner image, e.g., on an OHP film as a transmitted light image or a projected image on a screen, however, the transmission characteristic and therefore the image quality are impaired if the toner image retains a particulate characteristic arising from the use of toner particles. Accordingly, there has been widely used a transparent film for color toner with increased light-transmission characteristic by decreasing the particulate characteristic of a toner image after fixation. Such a transparent film may be constituted as a laminate film as shown in FIG. 19 comprising a first transparent resin layer 441 having a heat resistance, and a second transparent resin layer 442 comprising a transparent resin which is compatible with the binder resin of a toner to be used for color image formation and has a heat-melting characteristic at the fixing temperature which is different from that of the binder resin.

Figure 19:
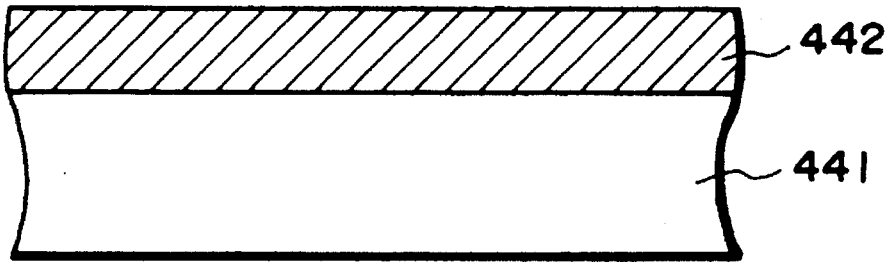

Referring to FIG. 19, the first transparent resin layer (base film) 441 as a transparent sheet member of the transparent film is required to have a sufficient heat resistance so as not to cause a remarkable thermal deformation by heating for heat fixation or heat-pressure fixation. Specific examples of a material constituting the base film 441 may include polyethylene terephthalate (PET), polyamide and polyimide each having a heat-resistance in terms of maximum usable temperature of at least 100° C. Among these, polyethylene terephthalate is particularly preferred in view of the heat resistance and transparency. The base film 441 is required to have a sufficient thickness so as to cause wrinkles even when softened under heating for fixation, which may be 50 μm or larger for the above-mentioned resins. A larger thickness tends to decrease the transmittance, so that the base film 441 may suitably have a thickness of 50–200 μm, preferably 70–150 μm.

The second transparent resin layer 442 is an overcoating layer for improving the light-transmission characteristic of a color image after fixation. The overcoating layer 442 may comprise a resin which is compatible with the binder resin of a toner constituting the color image at a heat-fixation temperature and may suitably have a solubility parameter within the range of ±1.5, preferably ±1.0, with respect to the solubility parameter of a principal binder resin. The solubility parameters of various resins are described in many publications like a polymer handbook. For example, when a toner comprising a polyester resin having a solubility parameter of about 11.0, the overcoating layer 442 may suitably comprise a resin having a solubility parameter in the rate of 11.0±1.5, examples of which may include thermoplastic resins, such as polyester resin, polymethyl methacrylate resin, epoxy resin, polyurethane resin, vinyl chloride resin, and vinyl chloride-vinyl acetate copolymer resin. Generally, a wide scope of resins similar to principal constituent resins of toners concerned may be used.

The resin for the overcoating layer 442 may have a storage modulus (G') at 160° C. of 100–10000 dyne/cm$^2$. If the resin has a storage modulus at 160° C. of below 100 dyne/cm$^2$, the offsetting of a toner image is liable to occur at the time of fixation by means of hot-pressure rollers, and also the overcoating layer 442 is liable to be damaged by partial peeling from the base film. On the other hand, when the resin constituting the overcoating layer has a storage modulus (G') at 160° C. of above 10000 dyne/cm$^2$, the toner image little penetrates into the overcoating layer as a result of heat-pressure fixation, the resultant projection image is liable to show a grayish tint. The storage modulus (G') of a resin constituting the overcoating layer may be measured by Dynamic Spectrometer RDS 7700 series II (available from Rheometrics Inc.). The overcoating layer may suitably have a thickness of 3–40 μm, while the optimum thickness can vary depending on the particle size of a toner used.

The roughening of a transparent film as described above for forming an opaque part, may be performed by imparting small scars onto the surface of the transparent film, particularly the overcoating layer 442 in the case of a laminate film as shown in FIG. 19, by abrading means such as sand paper.

Another example of the random reflection layer causing random reflection of light incident to the transparent film may be constituted similarly as the opaque mark (sensing mark) 111 in the transparent film 110 shown in FIG. 1 of the type that can be detached under heating.

More specifically, such an opaque mark 111 may be constituted by resin particles or emulsion particles and a binder formed on a transparent sheet member 113 optionally with an anchor coat or adhesion-control layer 112 as shown in FIG. 1.

The opaque mark 111 causes random reflection of light incident thereto because of the resin particles or emulsion particles attached to the sheet member 113 and is caused to form a smooth transparent film on heating through softening under heating of the resin particles.

In this case, the anchor coat layer 112 may be disposed to increase the adhesion between the sheet member 113 and the opaque mark 111.

The materials for the resin particles, binder and anchor coat layer may be selected from the classes of materials described in the first embodiment of the type allowing the detachment under heating but may preferably be selected so as to ensure a sufficient adhesion between the opaque mark and the sheet member.

The resin constituting the opaque mark is required to have a melting temperature which is lower than the softening temperature of the sheet member 113. More specifically, in the case of using polyethylene terephthalate for the sheet member as usual, the resin may be one that is clarified at a temperature below the softening point of the polyethylene terephthalate, particularly at a temperature of at most 150° C.

Further, in this case of clarifying the opaque part (mark) by heating, it is appropriate to apply an increased amount of release agent to the pressure roller than in the first embodiment of removing the opaque part by heating, so as not to cause offset of the opaque mark onto the pressure roller.

The application amount of the release agent applied to the pressure roller for not causing an offset of the opaque mark onto the pressure roller should be appropriately set depending on the materials concerned but may preferably be set to at least 100 μg/cm$^2$, more preferably at least 150 μg/cm$^2$ in terms of the amount of the release agent applied onto the fixing roller abutted to the pressure roller, e.g., in the case of using a combination of materials adopted in Example 7 described hereinafter, i.e., (i) using a pressure roller comprising an aluminum core member coated with a lower layer of HTV silicone rubber and then with a surface layer of polytetrafluoroethylene, (ii) a release agent comprising dimethylsilicone oil having a viscosity of 300 centi-Stokes and (iii) an opaque mark formed by a composition A comprising emulsified thermoplastic elastomer resin/emulsified ionomer resin/sodium dioctylsulfosuccinate (mixed in ratios of 100/12/0.3), so as to provide a condition that the clarification of the opaque mark is performed in the presence of a sufficient amount of the release agent absorbed by the pressure roller.

According to a third embodiment, the transparent film according to the present invention is provided with an opaque part (mark) which can be clarified by heating and/or light illumination.

The opaque part (mark) of the transparent film may be formed by application of a printing ink containing a colorant (dye or pigment) which can be sublimed or discolored due to a structural change on heating and/or light illumination. A preferred example of such an ink may be one containing a sublimation dye or a cationic dye.

The transparent film according to this embodiment may be formed by printing an opaque mark with such an ink on a transparent sheet member. The thus-printed opaque mark contains a colorant (dye or pigment) which can be sublimed or discolored on heating and/or light illumination, so that the opaque mark can be discolored due to sublimation or discoloration of the colorant by heating and/or illumination in a step after image formation, thereby leaving no adverse effect on the resultant transparent film having a color image, e.g., for projection by an OHP.

Figure 2:
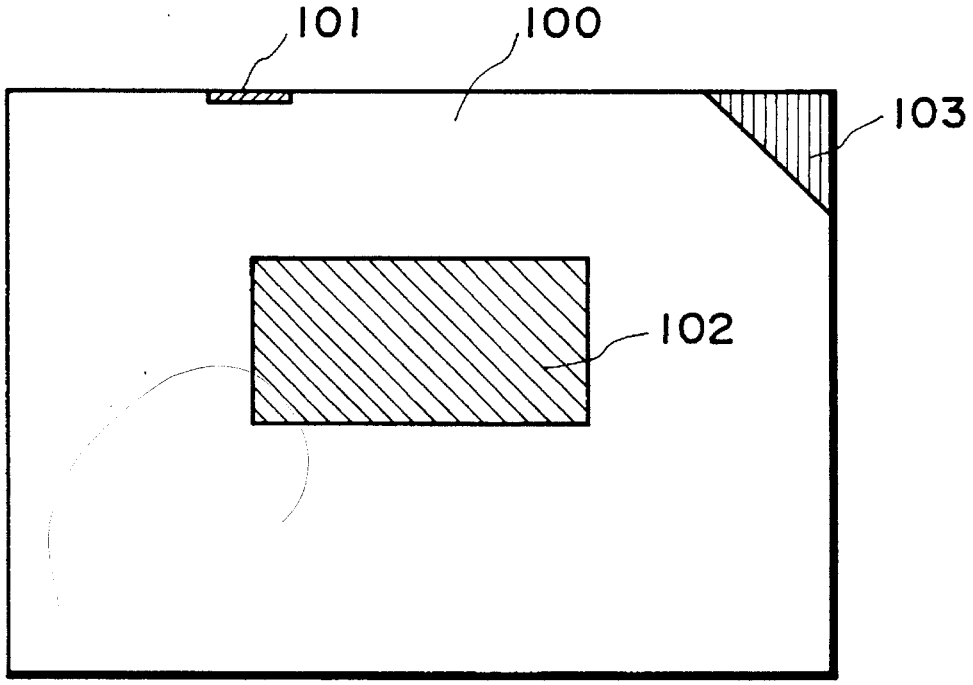
FIG. 2 is a schematic plan view for illustrating printed opaque marks on a transparent film according to the invention.

FIG. 2 shows an example pattern of opaque mark.

Hitherto, a transparent film is provided with an opaque mark for detection only at a marginal and minor part 101, so that it can provide a slight signal to a detecting sensor and therefore severe requirements are imposed on the opaque mark regarding the density and the surface characteristic.

In the transparent film according to the present invention, however, the opaque mark for detection is formed by printing with a discoloring ink, so that it is possible to form an opaque mark 102 of a large area at a central part of the film or an opaque mark 103 of a large area at a side of the film. Further, it is even possible to form an opaque mark over the entire area of the film. The opaque mark may preferably be formed in a thickness of about 0.5–10 μm.

It is also preferred that the opaque mark is formed on a side of the transparent film opposite to the side on which a toner image is fixed.

The transparent film comprises an optically transparent sheet member which may comprise any film material usable for an OHP, such as a polyethylene terephthalate film. The film may preferably be coated with a 1–20 μm-thick, further preferably 1–5 μm-thick, layer of an aqueous polyester resin containing silica or an anti-static agent so as to improve the conveyability. The coating may be effected by any known method onto one or both sides of the film.

The anti-static agent may be added as desired, preferably so as to provide a surface resistivity of $5\times10^{7}$–$5\times10^{10}$ Ω in an environment of temperature of 20° C. and a humidity of 60% RH for a full-color copying machine including a superposing multi-transfer operation.

The image forming apparatus using a transparent film according to the present invention will now be described more specifically.

First of all, a four-color full color copying machine as an embodiment of an image forming apparatus capable of using a transparent film according to the present invention will be described with reference to FIG. 20.

The copying machine include in its main body four image forming units, i.e., Pa, Pb, Pc and Pd from the upstream side (right side of FIG. 20), so as to provide images of four colors (cyan, magenta, yellow and black), each through the steps of charging, exposure, development and transfer. The image forming units Pa, Pb, Pc and Pd have image-holding members 1*a*, 1*b*, 1*c* and 1*d* respectively therefor, which are respectively an electrophotographic photosensitive drum (herein after simply referred to as "photosensitive drum"), so that toner images formed on these photosensitive drums are successively transferred onto a recording medium 6 carried and moved adjacent to the image forming units by a carrying member 8, and the recording medium 6 carrying the transferred toner images in superposition is subjected to heat and pressure to fix the toner image and then discharged out of the machine.

Next, the structure and operation are described in order from the latent image forming section. Surrounding and above the photosensitive drums 1*a*, 1*b*, 1*c* and 1*d* rotatably disposed, there are disposed exposure lamps 21*a*, 21*b*, 21*c* and 21*d*, light sources (not shown); polygonal mirrors 17 for scanning light issued from the light sources; and potential sensors 22*a*, 22*b*, 22*c* and 22*d*. First, the photosensitive drums 1*a*–1*d* are uniformly charged by the chargers 2*a*–2*d*. Laser beams issued from the light sources (not shown) are deflected for scanning by the rotatable polygonal mirrors, further deflected by reflective mirrors and condensed by f-θ lenses onto generatrix lines of the photosensitive drums 1*a*–1*d* to illuminate the photosensitive drums, thus forming latent images corresponding to given image signals on the respective photosensitive drums.

Developing devices 3*a*–3*d* are loaded with prescribed amount of developers (toners) of cyan, magenta, yellow and black from respective supplying devices (not shown). The latent images formed by scanning light on the photosensitive drums 1*a*–1*d* are developed with the developers from the developing devices to form visible images (toner images) on the photosensitive drums 1*a*–1*d*.

Recording media 6 for receiving toner images are held in a recording media cassette 60, sent via a paper supply roller 13*a* and a register roller 13*b*, carried by the carrying member 8 in the form of an endless belt and sent successively to the photosensitive drums 1*a*–1*d*. The recording medium carrying member 8 comprises a film or sheet of dielectric resin, such as polyethylene terephthalate resin (PET), polyvinylidene fluoride resin, or polyurethane resin, in the form of an endless belt with a seam formed by joining both ends of such a sheet or a seamless endless belt. (In the case of an endless belt with a seam, a means for detecting the seam may be provided in some cases so as not to transfer a toner image onto the seam.) The carrying member 8 is wound about upstream rollers 11 and a downstream roller 10 and, when the carrying member 8 begins to move, a recording medium 6 is supplied to the carrying member 8 from the register roller 13*b*. At this time, an image writing signal is turned ON, and image formation is performed on the most upstream photosensitive drum la at a timing. Then, at a lower part of the photosensitive drum 1*a*, a toner image on the photosensitive drum 1*a* is transferred onto the recording medium 6 pressed under a uniform pressure exerted by a transfer pressing member under the action of an electric field imparted by a transfer charger 4*a*. The recording medium 6 is held and carried under the action of an electrostatic attraction force by the carrying member 8 and then conveyed to the subsequent image forming unit Pb where a magenta toner image is formed on and transferred from the photosensitive drum 2*b* onto the recording medium 6 in a similar manner. According to similar manners, a yellow toner image and a black toner image are transferred from the photosensitive drums 1*c* and 1*d* to the recording medium 6. The recording medium 6 carrying the four-color toner images is charge-removed by a separation charger 14 and a peeling charger 15, separated from the carrying member 8 due to attenuation of the electrostatic attraction force and conveyed to the fixing unit or device 7.

The fixing unit includes a fixing roller 71, a pressure roller 72, heat-resistant cleaning members 73 and 74 for cleaning the rollers, heaters 75 and 76 for heating the rollers, an oil applicator roller 77 for applying a release agent oil such as dimethylsilicone oil onto the fixing roller 71, an oil reservoir 78 for supplying the oil, and a thermistor 79 for controlling the fixing temperature. The recording medium 6 conveyed from the carrying member 8 to the fixing unit is subjected to heat and pressure to fix the toner image onto the surface thereof. The recording medium 6 having the fixed toner image thereon is then discharged out of the machine.

The respective photosensitive drums 1*a*–1*d* after the transfer, i.e., free from toner images, are then subjected to removal of the remaining toners thereon by the respective cleaning devices 5*a*–5*d* and then prepared for subsequent latent-image formation. Further, developers remaining on the recording medium carrying member 8 are charge-removed by a belt charge-remover 12 to lose the electrostatic attraction force, and taken off by a rotatable fur brush 16 into a recovery chamber 9. Other means for removing the developer, such as a blade, unwoven cloth or a combination of these, may also be used.

Figure 21:
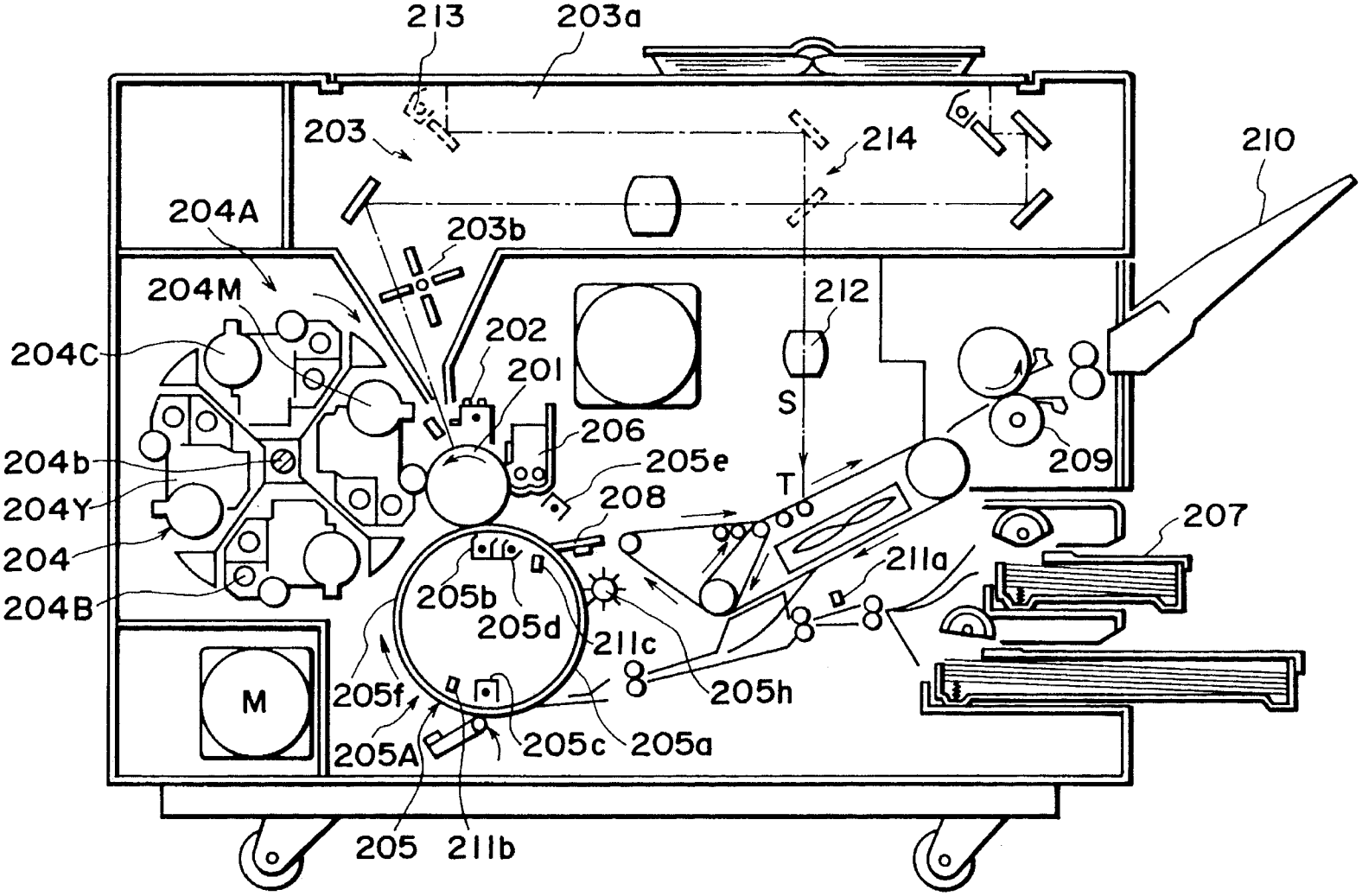
FIG. 21 is an illustration of a copying apparatus capable of using a transparent film according to the invention.

FIG. 21 shows full-color electrophotographic apparatus as another embodiment of an image forming apparatus capable of using a transparent film according to the present invention.

In the full-color electrophotographic apparatus, a recording medium such as paper or a transparent film according to the invention held in a cassette 207 is conveyed to and wound about a transfer drum 205, and four toner images of magenta, cyan, yellow and black successively formed on a photosensitive drum 201 corresponding to electrostatic latent images formed on the photosensitive drum 201 and as a result of successive development by four developing devices 204M, 204C, 204Y and 204B are successively transferred onto the recording medium to form a full-color image. Then, the recording medium is further conveyed to a hot-curl fixing device 209, where the toner image is melt-fixed under heating to form a fixed full-color image.

Figure 22:
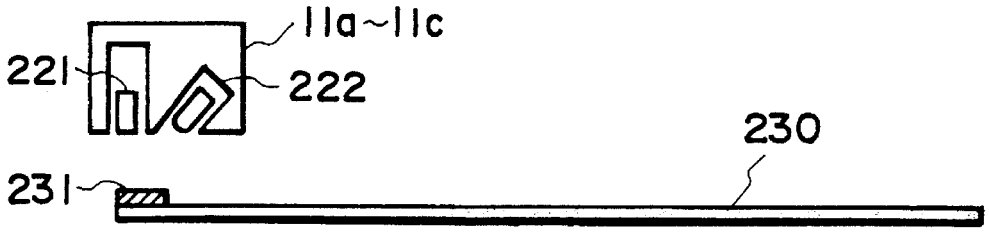
FIG. 22 is an illustration of a method of detecting the conveyance state of a transparent film according to the invention.

In the full-color electrophotographic apparatus, three reflection-type sensors are disposed at three parts 211*a*, 211*b* and 211*c* for detecting the conveyance state of the recording medium. As shown in FIG. 22, each sensor may for example comprise an LED 221 capable of emitting light of near infrared rays at about 980 nm and a photodiode 222 for detecting light reflected from an opaque mark 231 for detection formed on a recording medium 230 as a result of the incidence of the near infrared light thereto.

In order to effectively detect the reflected light from various recording media, an optical system therefor may be designed as desired, but a system of utilizing random reflection of LED light is a preferred embodiment.

Image forming apparatus according to the present invention may be constituted by including means for forming an arbitrary image on a transparent film having an opaque part thereon according to the invention as described above, and means for clearing the opaque part by removing the opaque part by separation on heating, clarifying the opaque part by heating the opaque part and clarifying the opaque part by heating and/or light illumination.

As described above, any known means may be used for forming an arbitrary image on a transparent film.

The detachment of the opaque part (mark) by heating may be performed by heating the transparent film to soften the opaque substance constituting the opaque mark to impart the mark with a viscosity or an adhesiveness, and transferring the mark onto a fixing roller by adhesion thereto or decreasing the amount of a release agent applied onto a pressure roller so as to cause offsetting of the opaque mark onto the pressure roller.

The clarification of an opaque mark by heating may be performed by heating an opaque mark formed by roughening a part of a transparent film surface to smooth the opaque mark, or by heating an opaque mark formed by coating with resin particles or emulsion particles to convert the particles into a film.

The clarification of an opaque mark by heating and/or light illumination may be performed by forming an opaque mark with a printing ink containing a sublimable or discoloring colorant and subjecting the opaque mark to heating and/or light illumination to cause the sublimation and/or discoloration due to structural change of the colorant. The light illumination for clarifying the opaque mark may be performed by illuminating the opaque mark by, e.g., a halogen lamp and a semiconductor laser.

As described above, according to the present invention, a transparent film is provided by forming thereon an opaque part (mark) which can be detected by an optical sensor and can be cleared (removed or clarified) simply by a prescribed treatment, whereby the size and the right or wrong side of the transparent film can be accurately detected by utilizing the opaque mark during the image formation and, after the image formation, the opaque mark can be cleared to provide a transparent film product having an image free from an opaque part adversely affecting, e.g., in a projected image on a screen formed by an OHP apparatus.

Further, by using an image forming apparatus including an optical sensor for detecting such an opaque mark and means for clearing (detaching or clarifying) the opaque mark, the size and the right or wrong side of a transparent film having the opaque mark can be easily detected by the optical sensor for image formation and, after the image formation, the opaque mark can be easily cleared.

Hereinbelow, the present invention will be more specifically described based on Examples, which however should be understood not to restrict the scope of the present invention. In the Examples, "part(s)" and "%" used to describe formulations are all by weight.

EXAMPLE 1

Figure 3:
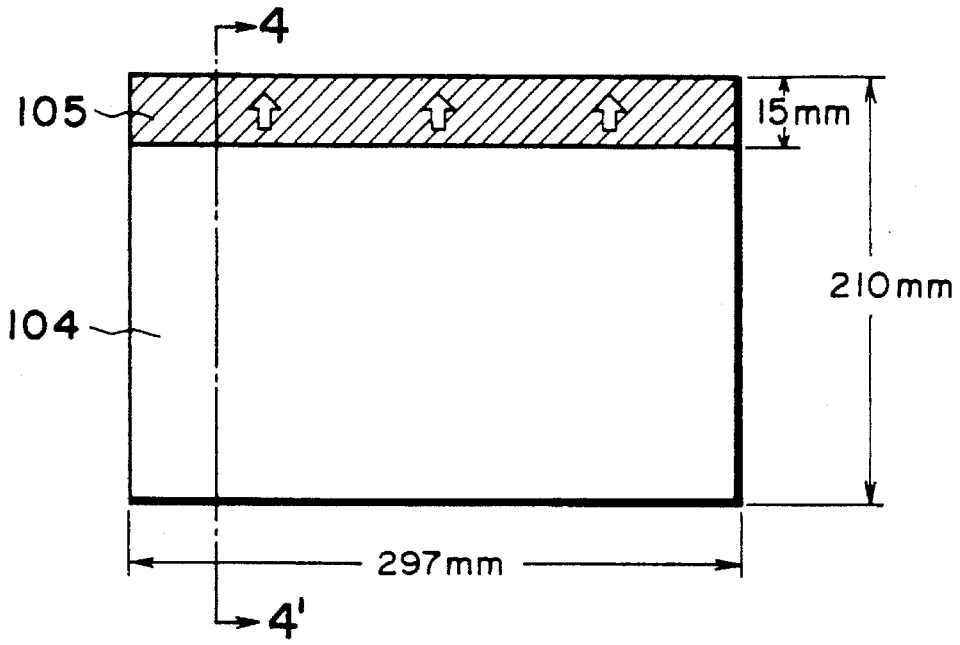
FIG. 3 is a plan view of a transparent film used in Examples of the invention.
Figure 4:
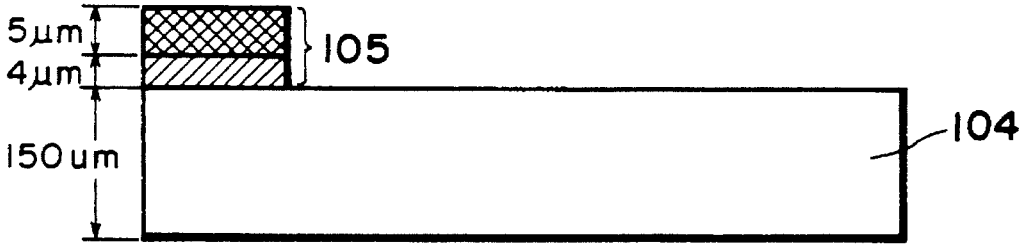
FIG. 4 is a view of A—A section in FIG. 3.

FIG. 3 is a plan view of a transparent film according to the invention used in the present invention. The transparent film has an opaque part (mark) 105 formed with an opaque material on a transparent sheet member 104. FIG. 4 is a sectional view of the transparent film taken along the line A—A as viewed in the directions of arrows in FIG. 3.

In a specific example, the transparent film was formed by cutting a 150 μm-thick polyethylene terephthalate (PET) film into an A4-size to provide a transparent sheet member 104, and applying along one side thereof paraffin wax (Tm (melting temperature)=70° C.) in a thickness of 4 μm and thereon a mixture of a polyester resin (Ts (softening temperature)=140° C.) and about 8 wt. % of a blue pigment dispersed therein in a thickness of 5 μm as shown in FIG. 4 to form an opaque part 105.

Figure 23:
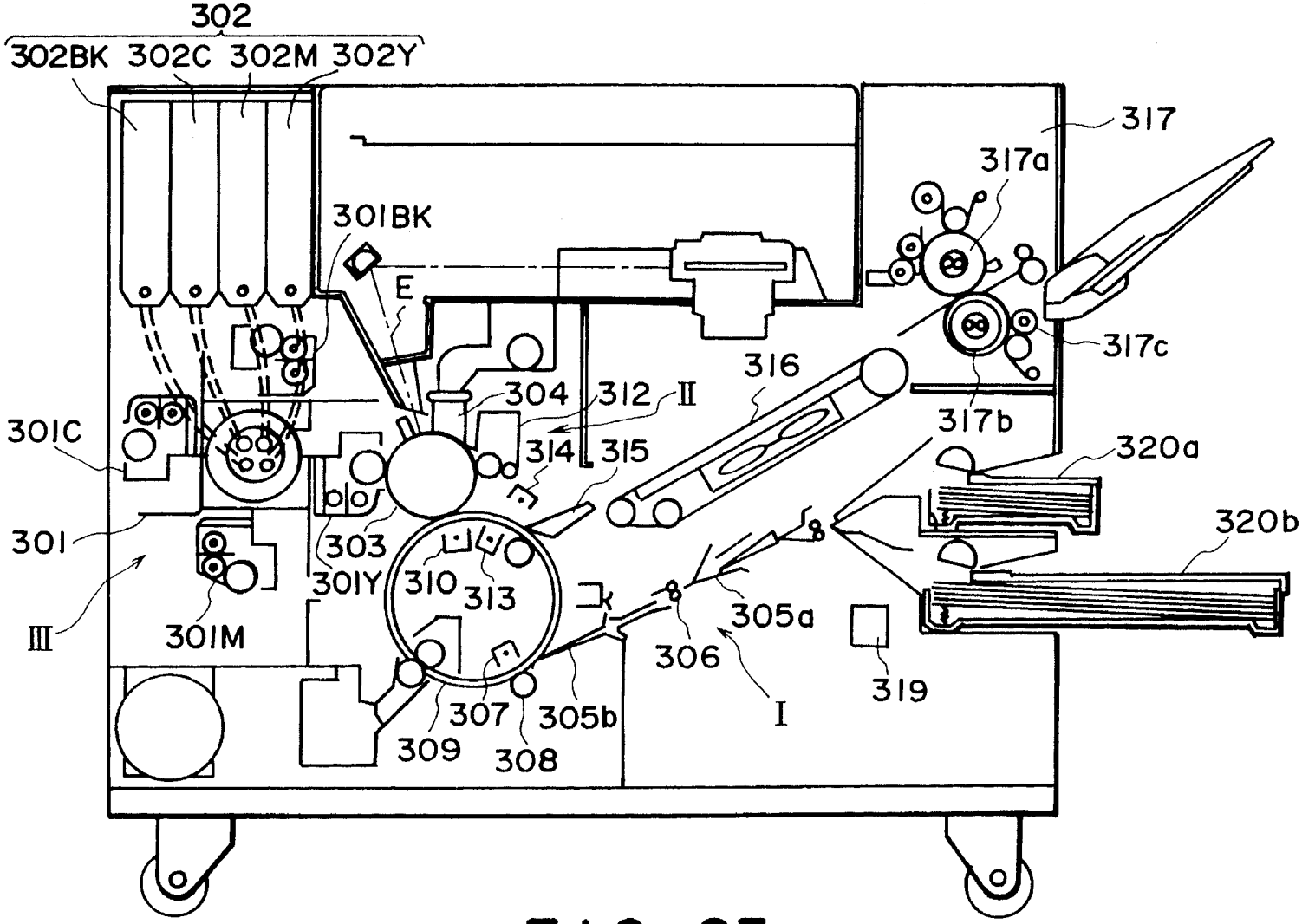
FIG. 23 is a sectional illustration of an electrophotographic color image forming apparatus used in Example 1.

The thus-formed transparent film was used in an electrophotographic image forming apparatus according to the invention as shown in FIG. 23 to form a transparent recorded image on the transparent film.

The electrophotographic full-color image forming apparatus shown in FIG. 23 is roughly divided into a recording medium-conveying system (I) including a transfer drum 309 and shown in a right-to-middle part of the apparatus, a latent image-forming section (II) disposed at the middle of the apparatus adjacent to the transfer drum 309, a rotary developing apparatus (III) as a developing means disposed adjacent to the latent image-forming section (II) and a developer-replenishing apparatus 302 as a developer supply means disposed adjacent to the rotary developing apparatus (III).

The recording medium-conveying system (I) includes recording medium-supplying trays 320*a* and 320*b* disposed releasably in an opening provided on the right side of the apparatus body 100; recording medium-supply guides 305*a* and 305*a* equipped with supply rollers 306; the transfer drum 309 rotatably disposed adjacent to the recording medium supply roller 305 and having an abutting roller 308, a gripper 307, a recording medium-separation charger 314 and a separation claw 315 in this order from its upstream to downstream in the direction of its rotation indicated by an arrow along its outer periphery and also a transfer charger 310 and a recording medium-separation charger 313 inside thereof; a conveyer belt means 316 disposed adjacent to the separation claw 315; a discharge tray disposed adjacent to the conveying end of the conveyer belt means 316 and extending outwardly from the apparatus body so as to be releasable from the body; and a fixing unit 317 disposed adjacent to the tray.

The latent image-forming section (II) includes an electrostatic latent image-holding member (i.e., photoconductive drum) 303 disposed rotatably in the direction of an arrow so that its outer periphery contacts the outer surface of the transfer drum 309, and a charge-removing charger 311, a cleaning means 312, a primary charger 304, an imagewise exposure means such as a laser beam scanner for illuminating the outer surface of the photosensitive drum 2 to form an electrostatic latent image thereon and an exposure light reflection means, disposed in this order from the upstream to the downstream in the direction of the rotation in the vicinity of the photosensitive drum 303.

The rotary developing apparatus (III) includes a rotating member 301, and a yellow developing unit 301Y, a magenta developing unit 301M, a cyan developing unit 301C and a black developing unit 301BK respectively disposed within the rotating member 301 so as to visualize an electrostatic latent image formed on the outer periphery of the photosensitive drum 303 when placed at a position facing the outer surface of the photosensitive drum 303.

The developer-replenishing apparatus 302 is equipped with a yellow hopper 302Y, a magenta hopper 302M, a cyan hopper 302C and a black hopper 302BK disposed adjacent to each other and storing developers of the respective colors supplied from outside.

Transparent films of A4-size as shown in FIG. 3 are set within the recording medium-supplying tray 320*a* of the image forming apparatus shown in FIG. 23 so that their side having the opaque part 105 faces upward and constitutes a side opposite to the side receiving a toner image.

The fixing unit 317 is one of the hot-pressure fixation type including a fixing roller 317*a* and a pressure roller 317*b* and allows a linear fixing speed of 60 mm/sec. In a specific example, the fixing roller surface temperature was controlled at 150°–160° C.

In the hot-pressure fixing unit 317, the surface of the opaque part 105 of the transparent film shown in FIG. 3 is softened to develop an adhesiveness onto the pressure roller 317*b*. The lower paraffin wax layer is melted to have a low viscosity, so that the opaque part loses an adhesive strength with the transparent sheet member 104 to be transferred to the pressure roller 317*b*.

The resin layer constituting the opaque part 105 and transferred to the pressure roller 317*b* is removed from the roller surface by a cleaning web 317*c*. The cleaning web 317*c* is formed of unwoven cloth having a surface smoothness of about 10 sec and is moved at a linear velocity of 5 mm/sec in a counter direction with the roller 317*b* to be wound up.

The recorded image obtained in the above-described manner retained an image on an otherwise entirely transparent film, thus being free from an ugly opaque part. On the other hand, during the image formation in the apparatus, the position of the transparent film was accurately detected by utilizing the opaque mark, so that highly accurate registration was ensured.

EXAMPLE 2

Figure 24:
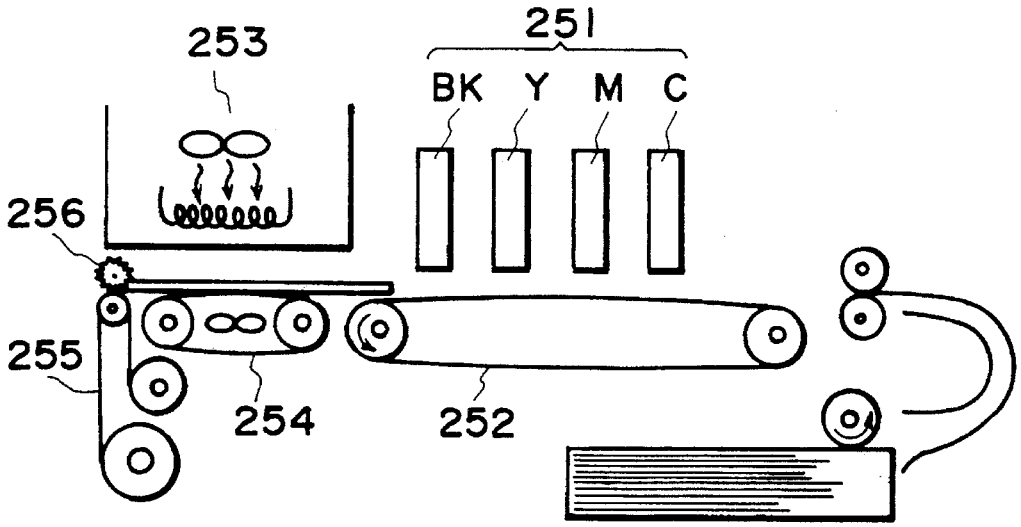
FIG. 24 is an illustration of a color image forming apparatus used in Example 2.

FIG. 24 illustrates a full-color image forming apparatus different from the one used in Example 1.

In the apparatus shown in FIG. 24, a full color image is formed on a recording medium held on an electrostatically attracting belt 252 by ejecting inks through a full-multi bubble jet printer head 251 including multiple nozzles C, M, Y and BK, followed by drying with warm air from a drier 253.

From the recording medium thus subjected to image formation, an opaque mark comprising an opaque material can be removed from the product transparent film by moving a cleaning web 255 at a speed equal to the recording medium heated to 100°–120° C.

Figure 5:
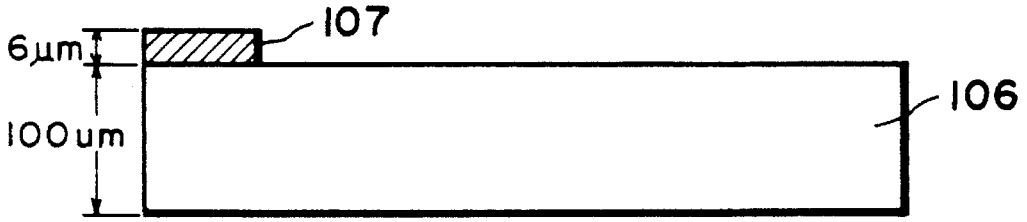
FIGS. 5 and 6 are sectional views of transparent films according to the invention used in Examples 2 and 3, respectively.

FIG. 5 is a sectional view of a transparent film as a recording medium used in this Example which was formed by coating a 100 μm-thick transparent sheet member 106 of PET with an opaque material obtained by dispersing titanium oxide (as a white pigment) within ester wax (Tm=60° C.) to form an opaque part (mark) 107 for detection.

The recording medium thus formed and subjected to the image formation in the above-described manner began to be heated while the conveying speed was lowered from 130 mm/sec to 20 mm/sec when the leading end thereof approached a separating position 256 in FIG. 24. As a result, the opaque mark comprising the heat-fusible material was not transferred to the attractive conveyer belt 254 but was removed by the cleaning web, thereby to result in a high-quality transparent recorded image free from ugly opaque mark.

EXAMPLE 3

Figure 6:
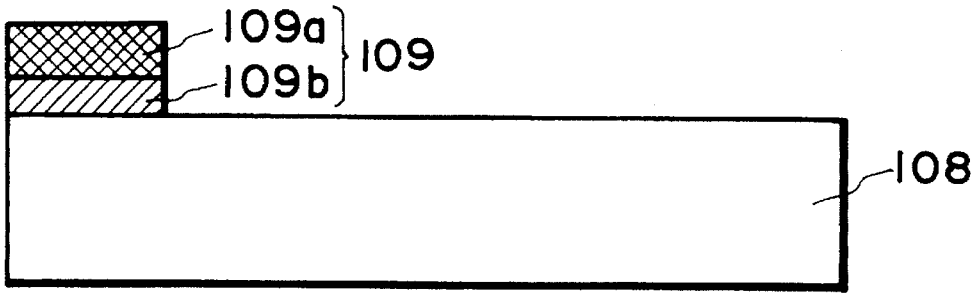

FIG. 6 is a sectional view showing a laminate structure of a transparent film used in Example 3 comprising an opaque mark 109 formed on a transparent sheet member 108.

The transparent film was formed by coating a 150 μm-thick PET film with a transparent layer 109*b* of a mixture of ester wax and carnauba wax having a melting point of 60° C. and showing a low viscosity of below 50 cp at 75° C. and a 10 μm-thick aluminum foil 109*a*.

Figure 25:
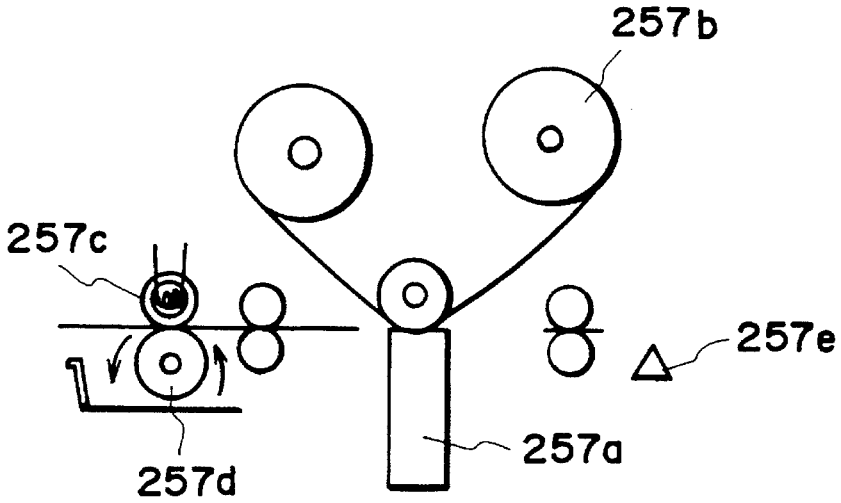
FIG. 25 is an illustration of an image forming apparatus used in Example 3.

FIG. 25 illustrates an image forming apparatus according to the invention used in this Example, which includes a thermal head 257*a*, an ink transfer sheet 257*b* having a transfer initiation temperature of 90° C., and a reflection-type photosensor 257*e* for detecting reflected light from the aluminum layer 109*a* of the opaque mark 109 formed on the transparent film to accurately detect the position of the transparent film during image formation according to the ink transfer.

The transparent film was conveyed so that its side opposite to the side having the opaque mark 109 contacted the transfer sheet 257*b*. After the image transfer, the opaque mark 109 comprising the aluminum foil 109*a* and the wax mixture layer 109*b* was heated from the opposite side by a heating roller 257*c* heated at 75° C. and removed by a silicone rubber roller 257*d* rotating at a higher speed than and disposed opposite to the heating roller 257*c*, whereby a high-quality transparent image was obtained free from ugly opaque mark.

EXAMPLE 4

A transparent film 110 similar to one shown in FIG. 1 but except for the anchor coat layer 119 was prepared by coating a 100 μm-thick PET film as a transparent sheet member 113 with a composition A shown below by a bar coater, followed by drying at 140° C. for 6 min. in a drying oven to form a 30 μm-thick opaque mark 111.

| <Composition A> | |
|---|---|
| Thermoplastic elastomer resin emulsion ("CHEMIPEARL A-100", mfd. by Mitsui Sekiyu Kagaku Kogyo K.K., solid content = 40%) | 100 parts |
| Ionomer resin emulsion ("CHEMIPEARL SA-100", mfd. by Mitsui Sekiyu Kagaku Kogyo K.K., solid content = 35%) | 12 parts |
| Sodium dioctylsulfosuccinate ("PELEX OT-P", mfd. by Kao K.K., solid content = 70%) | 0.3 part |

The opaque mark 111 of the transparent film thus formed was white-opaque and showed a haze value of about 70% as measured by a direct-reading haze meter.

Figure 20:
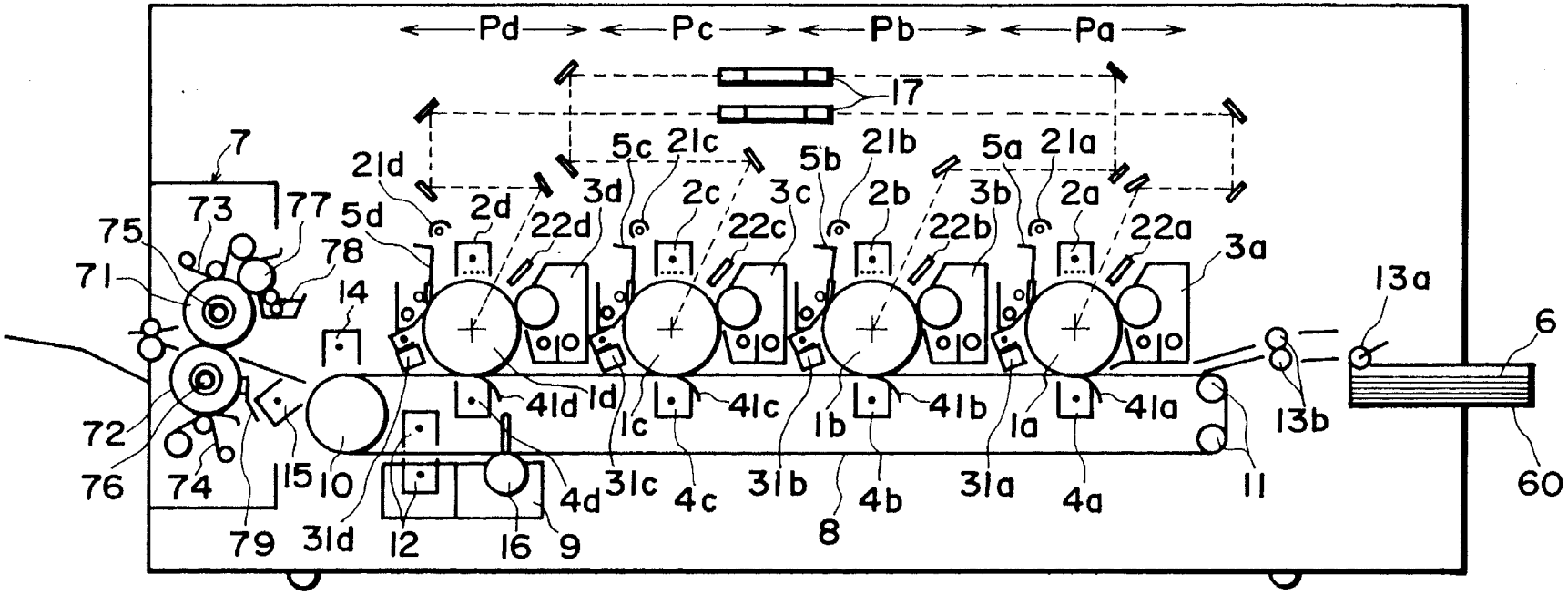
FIG. 20 is an illustration of a full-color (based on four colors) copying apparatus as an image forming apparatus according to the invention.

The transparent film 110 was inserted in an image forming apparatus as shown in FIG. 20 so that a side thereof opposite to the side having the opaque mark 111 was disposed to receive a toner image, and toner images were transferred thereto from the image forming units Pa, Pb, Pc and Pd in the manner described above and fixed by a fixing device 7 constituted in the following manner.

Fixing roller 71 surface layer: RTV silicone rubber, 200 μm-thick lower layer: HTV silicone rubber, 4 mm-thick core: aluminum Pressure roller 72 surface layer: polytetrafluoroethylene (PTFE), 20 μm-thick lower layer: HTV silicone rubber, 0.5 mm-thick core: aluminum Release agent 78 dimethylsilicone oil 300 centi-Stokes

Amount of release agent applied onto the fixing roller at the time of fixation: 32 $\mu g/cm^2$ The transparent film 110 having the toner images was fed to the fixing unit 7 constituted in the above-described manner and operated under the conditions of a roller temperature of 160° C., a fixing pressure of 3 $kg/cm^2$ and a fixing speed of 35 mm/sec., whereby the opaque mark 111 was peeled from the transparent sheet member 113 and offset to the pressure roller 72 showing a rather poor releasability because of substantially no release agent applied to the transfer roller 72.

The material constituting the opaque mark 111 may be removed by a cleaning device 74 for the pressure roller 72. In this instance, the feed rate of heat-resistant unwoven cloth constituting the cleaning device 74 may suitably be increased so as to enhance the cleaning performance for recording on the transparent film 110 than in recording on an ordinary recording medium such as plain paper.

In the above operation, in order to decrease the amount of the release agent 78 applied onto the backside of the transparent film 110 while maintaining the application of a sufficient amount of the release agent onto the upper side of the transparent film 110, it is suitable to delay the timing of the application roller 77 for applying the release agent 78 contacting the fixing roller 71 slightly than the timing of the conveyed recording medium 6 reaching the nip between the fixing roller 71 and the pressure roller 72. For example, it is suitable to set the timing so that the periphery of the fixing roller 71 to which the release agent 78 has been applied contacts the surface of the transparent film 110 at a timing when a leading marginal end of 2 mm has passed the nip if it is assumed that a leading end margin (non-image forming region) of the recording medium 6 is 10 mm at the time of image recording.

EXAMPLE 5

In Example 4, the opaque mark 111 comprising the composition A was formed on a side of the transparent film 110 opposite to the side receiving a toner image, but the present invention is not limited to such a configuration. Thus, it is also possible to form an opaque mark on the toner receiving side of a transparent film.

For example, in case where a leading end margin for image formation is 10 mm (i.e., the leading end for image formation is taken at a position of 10 mm from the leading end of the transparent film 110), an opaque mark may be formed in a line in a width of 2–3 mm in the range of 3 mm to about 6 mm respectively measured from the leading end of the transparent film, the timing of the release agent application may be so set that the release agent stably begins to be applied from a position between the opaque mark and the leading end for image formation, i.e., in the range of about 6 mm to 10 mm from the leading end of the transparent film, whereby a similar effect as in Example 4 can be obtained. In this case, however, it is preferred to increase the fixing temperature up to about 180° C. since the fixing roller having a good releasability is used to remove the opaque mark 111 by offsetting.

EXAMPLE 6

Figure 26:
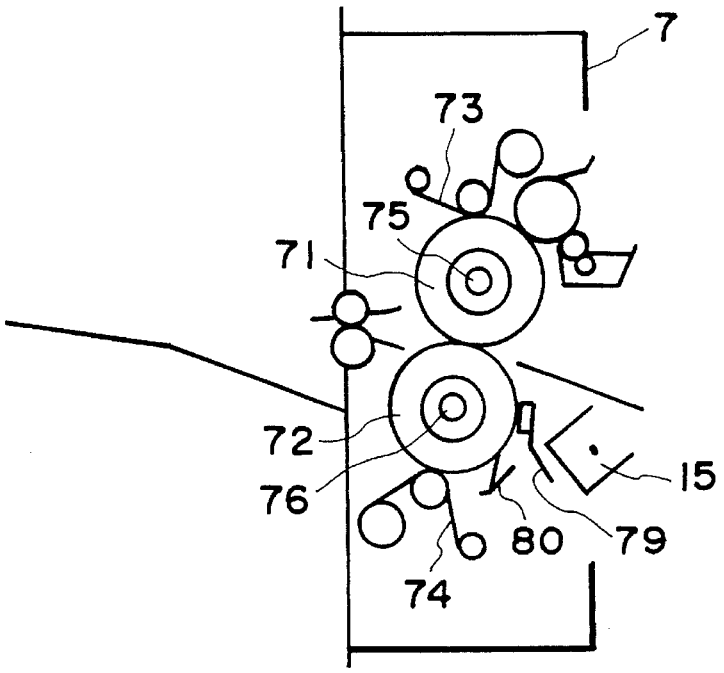
FIGS. 26 and 27 are longitudinal sectional views of fixing devices of image forming apparatus used in Examples 6 and 26, respectively.
Figure 27:
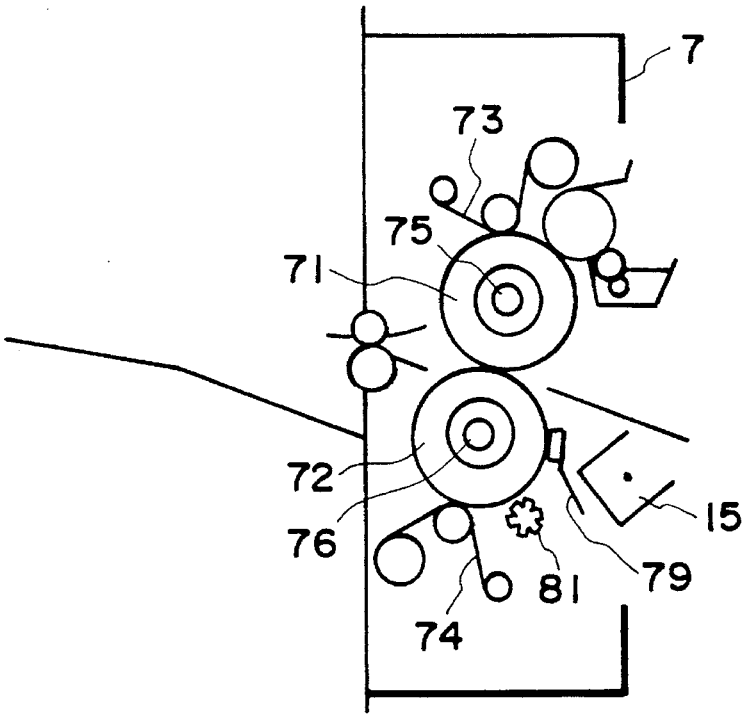

FIG. 26 is a longitudinal sectional view of a cleaning unit 7 equipped with a cleaning blade 80 exclusively for a pressure roller to be installed in the image forming apparatus shown in FIG. 20 corresponding to a case wherein the recording medium 110 shown in FIG. 1 is used. Unwoven cloth is used for roller cleaning in many cases but, in the case of using the recording medium 110 show in FIG. 1, the opaque mark 111 is offset to a roller in the form of a film to deteriorate the cleaning performance of the unwoven cloth. Accordingly, in order to compensate for the deterioration, the consumption of the unwoven cloth is inevitably increased, thus resulting in an increase in running cost. This difficulty is alleviated by providing an additional cleaning blade 80 equipped with a pressure release mechanism.

Further, it is also possible to attain a good effect by using a rotating brush 81 instead of the above-mentioned blade 80. In this case, a better cleaning performance is obtained if the brush 81 is rotated in the same direction as the pressure roller 72, so that the brush 81 and the roller 72 move opposite directions at the point where they contact each other.

EXAMPLE 7

A transparent film 110 having a structure identical to the one used in Example 4 was prepared, and toner images were formed on the transparent film and fixed thereto in the same manner as in Example 4 except that the organization of the fixing device 7 and the amount of the release agent were modified as follows:

Fixing roller 71 surface layer: RTV silicone rubber, 200 μm-thick lower layer: HTV silicone rubber, 4 mm-thick core: aluminum Pressure roller 72 surface layer: polytetrafluoroethylene (PTFE), 200 μm-thick lower layer: HTV silicone rubber, 1 mm-thick core: aluminum Release agent 78 dimethylsilicone oil 300 centi-Stokes

Amount of release agent applied onto the fixing roller at the time of fixation: 160 $pg/cm^2$ During the fixing operation, the oil supply to and oil absorption by the pressure roller 72 were ensured because of application of a large amount of the release agent onto the fixing roller 71 in contact with the pressure roller 72, so that the offsetting of the opaque mark 111 onto the pressure roller 71 was prevented by a sufficient releasability exhibited by the pressure roller, but the opaque mark 111 was smoothed under the action of heat and pressure exerted by the pressure roller to form a transparent smooth film layer showing a haze value of about 10% after the fixing in contrast with about 70% before the fixing. Thus, the resultant transparent film product could be used for projection by an OHP without being adversely affected by the smooth film resultant from the opaque mark.

EXAMPLE 8

A transparent film 110 similar to the one used in Examples 4–7 was prepared in the same manner as described in Example 4 except that the following composition B was used instead of Composition A.

| <Composition B> | |
|---|---|
| Styrene-acrylic copolymer resin ("BONCOAT PP-1000", mfd. by Dai-Nippon Ink Kagaku Kogyo K.K., solid content = 45%) | 100 parts |
| Polyvinyl alcohol ("PVA-117", mfd. by Kuraray K.K., 10% aqueous solution) | 30 parts |
| Surfactant ("PELEX OT-P", mfd. by Kao K.K., solid content = 70%) | 0.3 part |

After the coating by a bar coater, the coating was dried at 80° C. for 10 min. in a drying oven.

The transparent film obtained by using the above Composition B showed similar effects as the one prepared by using Composition A when used in the processes of Examples 4–7.

EXAMPLE 9

Figure 7:
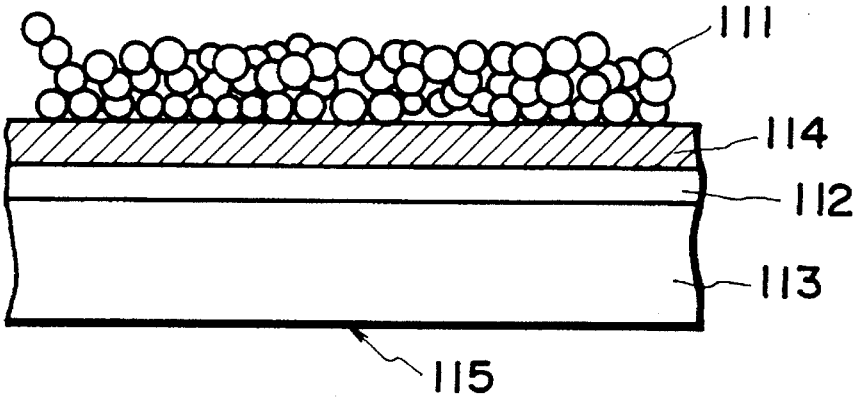
FIGS. 7 and 8 are sectional views of two types of transparent films according to the invention used in Example 9.
Figure 8:
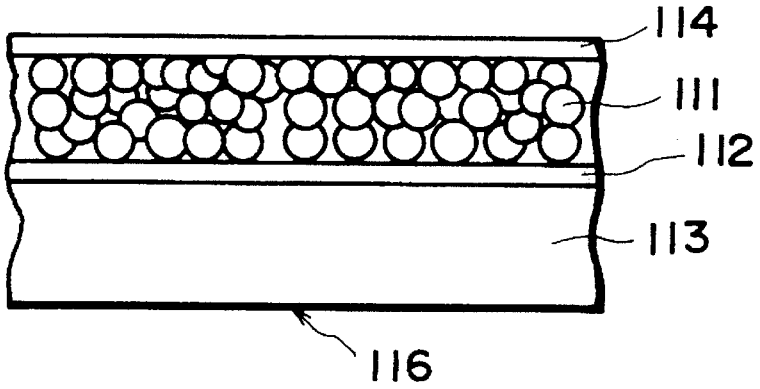

As shown in FIGS. 7 and 8, it is preferred to provide the transparent film according to the present invention with an absorbing layer 114 for absorbing moisture or a release agent, so as to prevent a deterioration of handling characteristic due to attachment of, e.g., a release agent. This is particularly preferred in a color copying machine using a release agent.

Referring to FIG. 7, a transparent film 115 is provided with such an absorbing layer 114 between an anchor coat layer 112 and an opaque mark 111 as described before.

In a specific example, a transparent film was prepared by using a commercially available moisture-absorptive film ("PICTRICO", mfd. by Asahi Glass K.K.) as a combination of a transparent sheet member 113 and such an absorbing layer 114 comprising siliceous porous particles and forming an opaque mark 113 on the absorbing layer by using Composition A similarly as in Example 4.

The transparent film was subjected to image formation and fixing operation in the same manner as in Example 7 whereby the opaque mark showing a haze value of about 70% was converted into a smooth film layer showing a haze value of about 15%.

A haze value of at most 20% is tolerable as not substantially adversely affecting a projection image by an OHP, but a haze value of at most 10% is preferred. The reason why the smoothed film layer resultant from the opaque mark in the above specific example showed a somewhat high haze value of about 15% might be attributable to random reflection caused by the release agent absorbed in the smoothed film layer.

FIG. 8 shows a transparent film 116 wherein the opaque mark 111 is shifted to below a release agent-absorbing layer 114 and the content of the binder resin therein is increased. Such a release agent-absorbing layer 114 may be composed of hydrophillic polymer, such as ionized polyvinyl alcohol or polyvinylpyrrolidone, crosslinked to be water-insoluble, or porous particles of silica or aluminum, and may be formed by application by using, e.g., a bar coater.

In a specific example, a transparent film identical to the one prepared in Example 4 after drying was coated with an absorbing layer of cationized polyvinyl alcohol by using a bar coater.

The opaque mark of the thus prepared transparent film showed a haze value of about 65% and a decreased haze value of about 10% after the fixing operation performed in the same manner as in Example 7.

EXAMPLE 10

Figure 9:
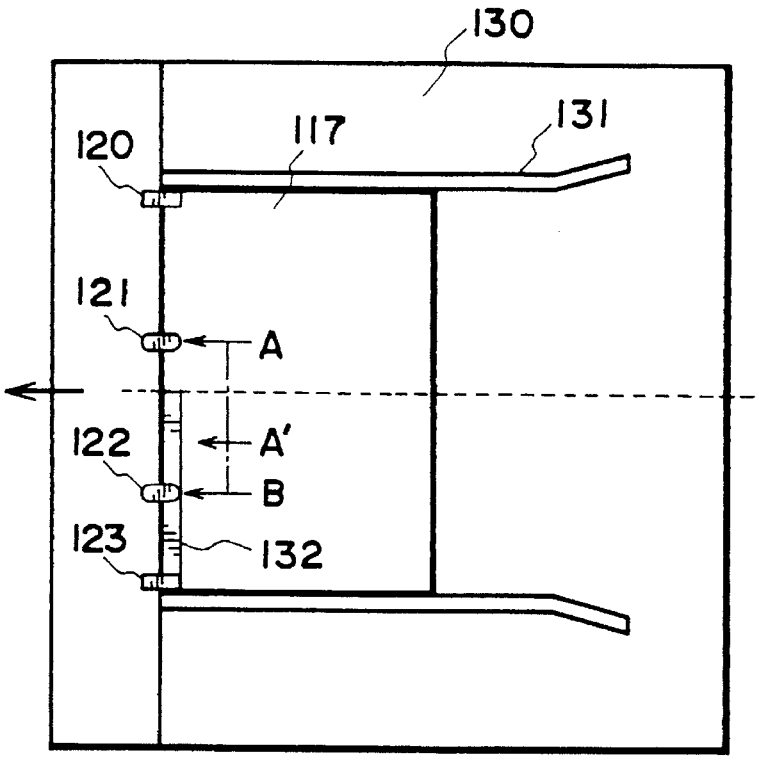
FIGS. 9 and 10 are top views for illustrating an operation in Example 10.

A transparent film 117 was prepared by forming a size mark 132 as an opaque mark as shown in FIG. 9 (a top view showing a state of the transparent film 117 being placed on a paper-supply unit 130 of an image forming apparatus) by applying Composition A on a PET film in the same manner as in Example 4.

Referring to FIG. 9, such a transparent film 117 provided with a size mark 132 is set along a paper-supply guide 131 of a paper-supply unit 130. Mechanical sensors 120 and 123 are disposed to detect whether a recording medium inclusive of such a transparent film 117 contacts the supply guide 131 in association with the supply guide 131. Details thereof will be described later.

On the other hand, optical sensors 121 and 122 are respectively disposed at a position A (at a prescribed distance from a supply center position denoted by a dashed line) and a position B (remoter than a position A' which is symmetrical with the position A with respect to the supply center position).

Figure 10:
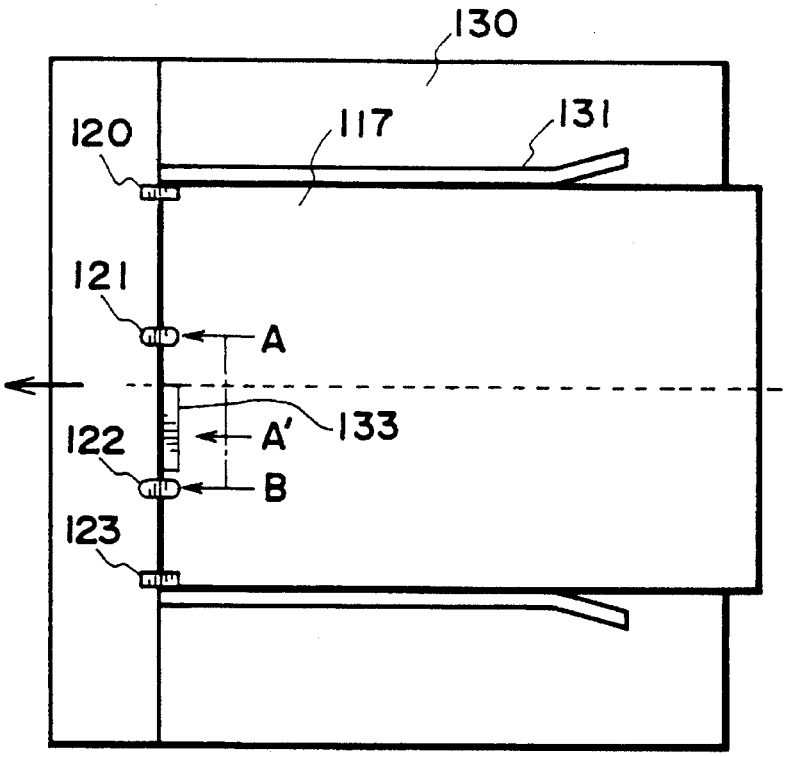

FIG. 9 shows a recording medium 117 of A4-size, and FIG. 10 is a corresponding view showing a recording medium 117 of A3-size. Hereinbelow, an example method of detecting A4 and A3 size media is described with reference to FIGS. 9 and 10.

In an ordinary image forming apparatus like a copying machine, recording media other than plain paper generally used are frequently fed through a manual supply cassette or tray. In this case, unlike the case of using a fixed size paper supply cassette, the size or material of a recording medium concerned is not readily recognized by the machine. More specifically, in the case of using a fixed size paper, the size detection can be performed based on the shape of the cassette. This detection method however cannot be applied to the manual supply mode. However, if the detection is impossible, it becomes impossible to utilize various functions of the apparatus, such as auto-size changing of output image size corresponding to the recording medium size, image shift and other various conversions, in the manual supply mode. Further, in case where the output image size is larger than the input recording medium size, a part of the output image can be transferred, e.g., onto the recording medium-carrying member 8 in the case of using the copying apparatus shown in FIG. 20, thus leading to soiling inside the machine and cleaning failure.

In order to solve the above problems, in the system illustrated in FIGS. 9 and 10, the width of the recording medium 117 is detected by the spacing or width of the supply guide 131, and the mechanical sensors 120 and 123 are used to detect whether the recording medium 117 is appropriately fit to the spacing of the supply guide 131. For this purpose, the mechanical sensors 120 and 123 are moved accompanying the movement of the supply guide 131. A transparent film 117 sometimes requires a detection of the right or wrong side thereof because, if image is recorded on the wrong side, conveyance failure can be caused in the fixing step or poor images can be produced. The detection is performed by the optical sensor 121.

In the system shown in FIGS. 9 and 10, the size marks 132 and 133 are used also for detecting the right or wrong side. If the wrong side medium is passed, the optical sensor 121 reacts to the mark 132 or 133. On the other hand, if the right side medium is passed, the light is passed (in the case of the optical sensor 121 being of the transmission-type), thus causing no reaction similarly as in the case of no detection. If the above-mentioned reaction state is represented by "1" and the no reaction state is represented by "0", the size detection of A4 or A3 in the system shown in FIGS. 9 and 10 is performed in the following manner:

A4=(sensor 121, sensor 122)=(0, 1)

A3=(sensor 121, sensor 122)=(0, 0)

Assuming that the recording medium size is either A4 or A3, one of the sensors 121 or 122 always shows "0". On the other hand, if the recording medium is plain paper, all the sensors show "1". Accordingly, the judgment as to whether the recording medium is a transparent film or plain paper may be effected in such a manner that the recording medium is a transparent film when either one of the sensors shows "0" and is plain paper when both show "1". In the above described manner, the preparation state of the recording medium, the material of a transparent film or plain paper, the right or wrong side of a transparent film and the size of the recording medium can be judged by the system described with reference to FIGS. 9 and 10. Further, as the opaque mark 132 and 133 can be cleared according to the present invention, e.g., by forming them with Composition A described above, the product transparent film having a recorded image is not adversely affected by remaining of the marks.

EXAMPLE 11

In the above Example 10, the width of the recording medium 117 is detected by the width of the paper supply guide 131, and the size marks 132 and 133 are used for supplemental size detection. However, the transparent film according to the present invention may be provided with various shapes of size marks which can be used for detection of all types of information, similarly as so-called "bar-code".

Figure 11:
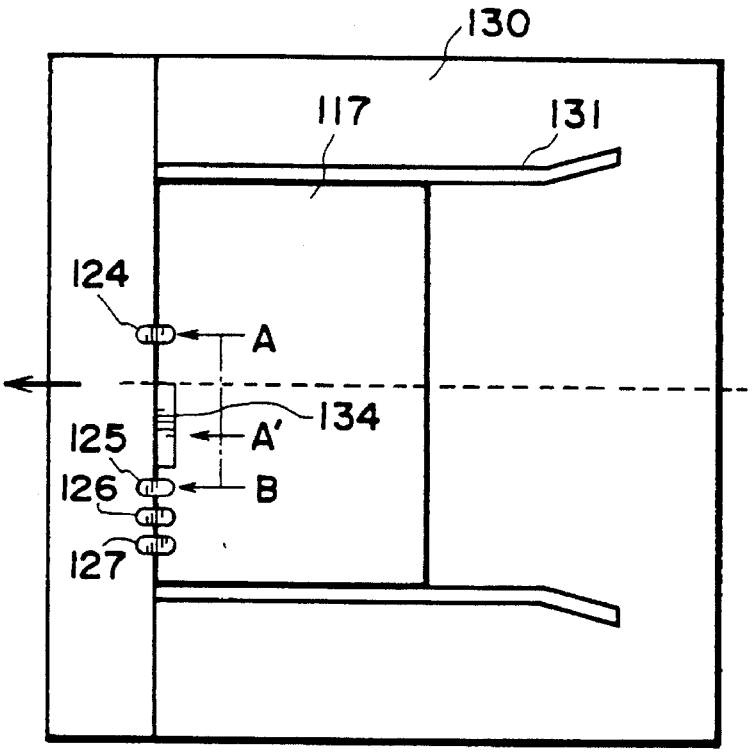
FIGS. 11 and 12 are top views for illustrating an operation in Example 11.
Figure 12:
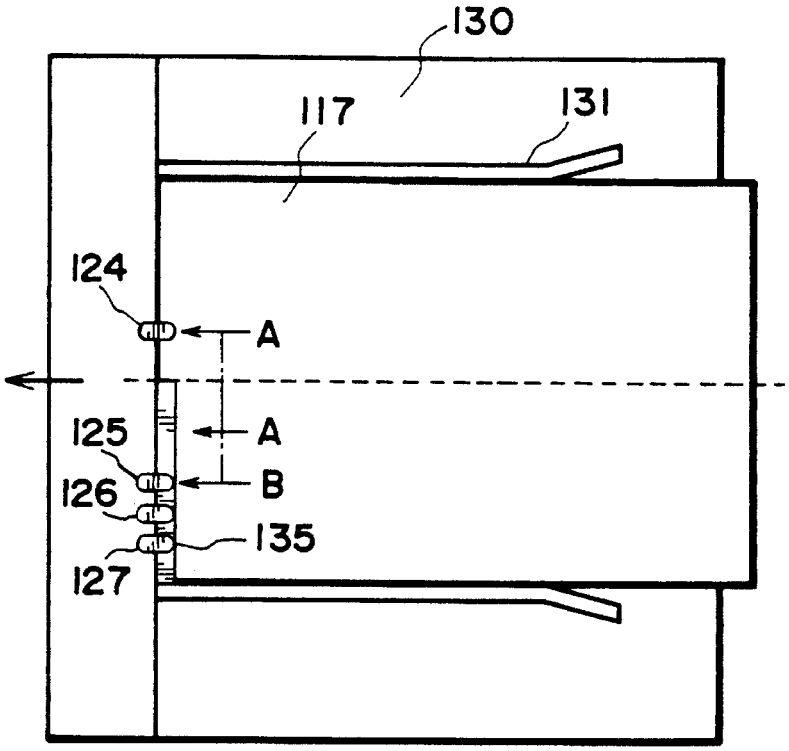

FIGS. 11 and 12 are top views similar to FIGS. 9 and 10 and respectively show a state of a transparent film 117 provided with a size mark 134 or 135 and being placed on a paper-supply unit 130 along a paper supply guide 131 for size detection by optical sensors 125, 126 and 127. An optical sensor 124 in FIGS. 11 and 12 functions similarly as the optical sensor 121 shown in FIGS. 9 and 10. The size of a transparent film can be judged depending on the reaction of the sensors 125–127 shown in FIGS. 11 and 12. Similarly as in Example 10, the sensors 125–127 detects a size mark by a signal level of "0" or "1". However, it is also possible to use a CCD line sensor instead of the sensors 125–127 or use a density level signal. In case where a density signal is used for size detection, if a density level as a sum of the signals from the sensors indicating recognition of no size marks may be represented by 00(H), a level indicating recognition of full size marks may be represented as FF(H) and a level indicating recognition of a half of size marks may be represented as 7F(H) or 80(H). In the case of using a transparent film 117 of A4 or A3 size with the size mark 134 or 135 shown in FIGS. 11 and 12, an A4-size transverse feed mode may be represent by 00(H), an A4-size vertical feed mode as shown in FIG. 11 (while the sensor 125 should detect the size mark 134) may be represented by 80H, and an A3 size feed as shown in FIG. 12 may be represented by FF(H), thus the size detection being effected.

As described above, if a recording medium size can be detected in the state of the recording medium being placed on a paper supply cassette, it is possible to smoothly effect various types of conversion as described above and, unlike in the case where a recording medium size cannot be detected until after it is conveyed, it is possible to obviate an inconvenience, such as size detection failure in a high-speed recording apparatus.

EXAMPLE 12

Figure 13:
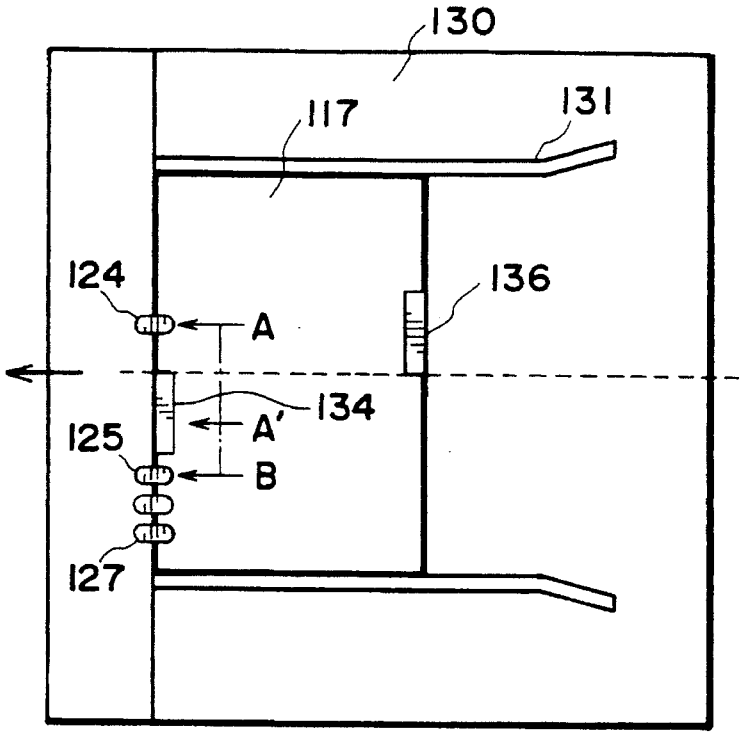
FIGS. 13 and 14 are top views for illustrating an operation in Example 12.
Figure 14:
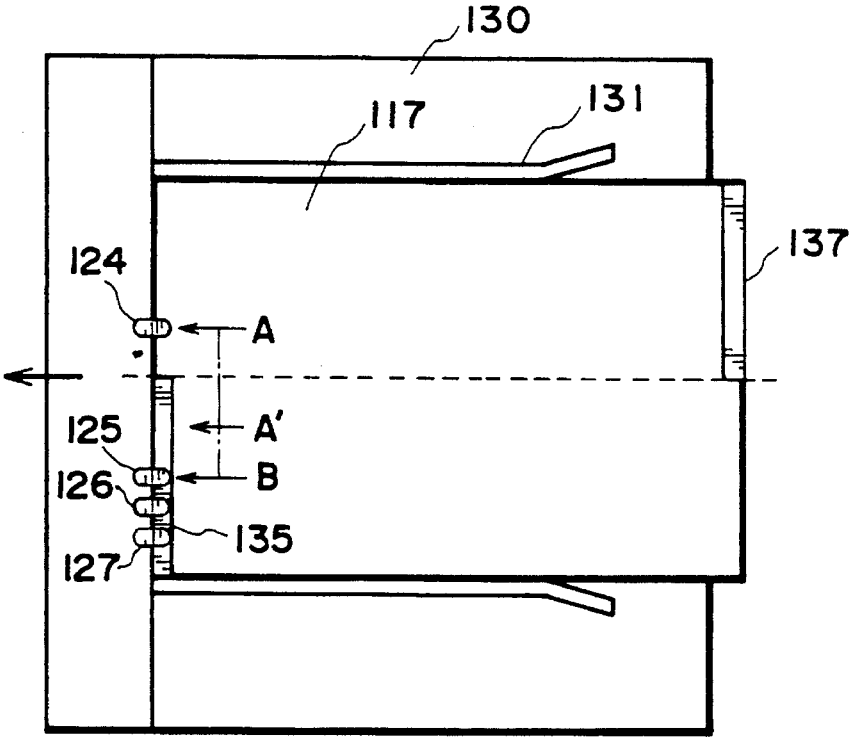

In the present invention, it is not necessary to dispose an opaque or size mark as described above only at a part of a transparent film 117. For example, as shown in FIGS. 13 and 14, it is possible to form additional size detection marks 136 and 137 on the opposite side so as to allow insertion of the recording medium 117 from the reverse side. It is also possible to form opaque marks at four corners. Such marks are cleared after recording according to the present invention. Accordingly, while the provision of such marks at several parts has caused a difficulty that the image forming area is narrowed thereby, such a difficulty is obviated by the present invention. Therefore, according to the present invention, it is not only possible to provide an improved handling characteristic of the transparent film 117 after the image recording but also possible to improve the processibility of the film at the time of setting it in the recording apparatus. Further, the size detection by the recording apparatus can be performed immediately after the setting of the recording medium, it is possible to improve the performances of various functions of the recording apparatus, such as automatic size change and automatic image shift.

EXAMPLE 13

Figure 15:
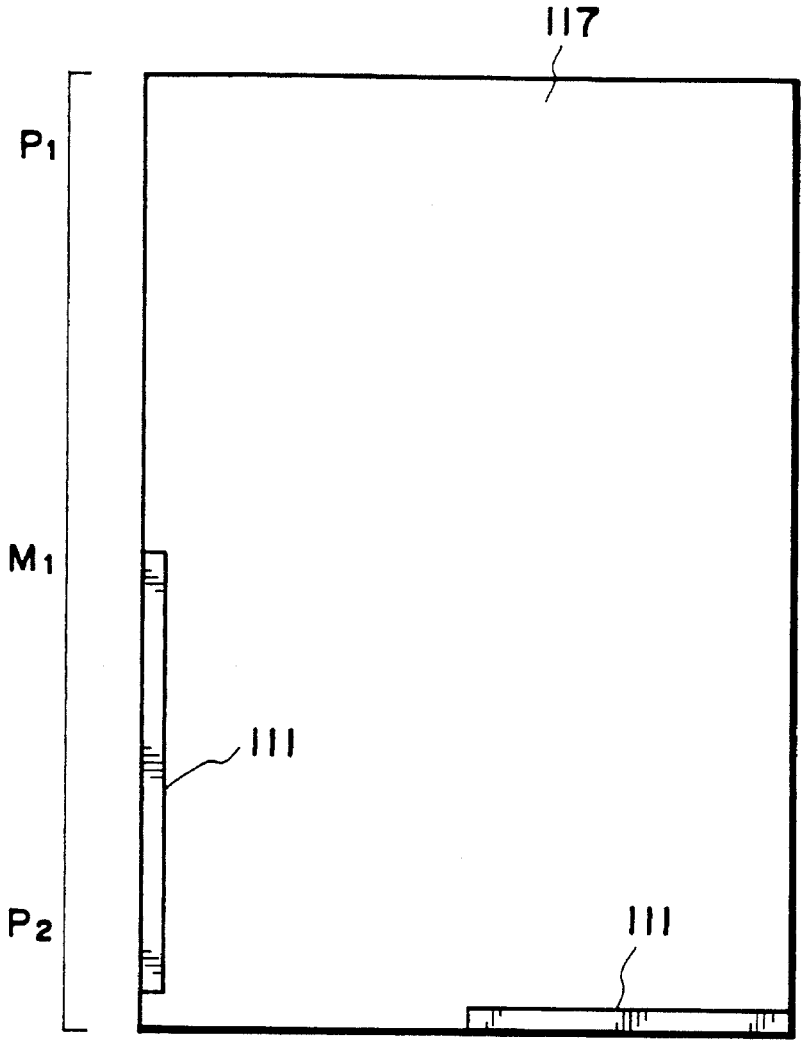
FIG. 15 is a top view for illustrating an operation in Example 13.

It is possible to detect the right or wrong size of a transparent film by using an opaque mark in combination with a fixing system. As an example of such a transparent film, FIG. 15 shows an A4-size polyethylenephthalate (PET) film 117 (mfd. by Toray K.K.) provided with opaque coating marks 111 shown in black. The PET film is transparent so that an optical transmission sensor does not react to the uncoated part thereof but reacts to the opaque coating mark interrupting light from the light emission device to the light-receiving device.

For example, the detection of the right or wrong side may be performed by a combination of one mechanical sensor and two transmission-type optical sensors. Referring to FIG. 15, it is assumed that a main body of an image forming apparatus is disposed on a left side of FIG. 15 including a mechanical sensor $M_1$ and transmission-type optical sensors $P_1$ and $P_2$ on both sides of the mechanical sensor $M_1$. In this arrangement, the presence or absence of a recording medium 117 is detected by the mechanical sensor $M_1$. Whether the recording medium is plain paper or a transparent film (inclusive of OHP film, label paper and an electric decoration material) may be made in such a manner that reaction by both sensors $P_1$ and $P_2$ indicates plain paper, and no reaction by any sensor indicates an inadequately prepared transparent film 117 (e.g., insertion from a reverse side having no detection mark in case of a transparent film 17 as shown in FIG. 15) or a recording medium of too small a size. In the latter case, the recording apparatus does not accept the recording medium and indicates an error message at the operating panel. Further, if the sensor $P_1$ reacts and the sensor $P_2$ does not react, this means that the transparent film is inserted upside down, and an error message is also shown in this case. In case where the sensor $P_1$ does not react and the sensor $P_2$ react as shown in FIG. 15, this means that the transparent film 117 is inserted in the right position, a recording on the transparent film 117 is started. The opaque marks 111 are disposed on a side of the transparent film 117 opposite to the side of image formation, so that it is possible to form an image at the parts of the opaque marks. The opaque marks after the image formation are clarified in the fixing device as described above. The absorption of a release agent by the opaque marks can somewhat increase the haze value of the opaque marks. If a user is still concerned about that, he can further remove the clarified by wiping with soft cloth or paper to cause peeling without disordering the image on the opposite side.

EXAMPLE 14

A conventional or known transparent recording medium is frequently provided with various surface coating so as to improve the image quality or the handling characteristic. In the present invention, it is possible to use such a transparent film (recording medium) as it is without sacrificing the characteristic thereof. Further, in the case of a laminate film like a label paper which is subjected to peeling of the backside film after the image formation to leave a front side film having a recorded image to be applied onto an object, the opaque mark 111 may be disposed on the backside film so as not to leave the opaque make on the image side. It is also possible to form an absorbing layer 114 comprising siliceous porous particles so as to absorb a release agent 78 and improve the handling characteristic of the resultant recording medium 117.

Figure 16:
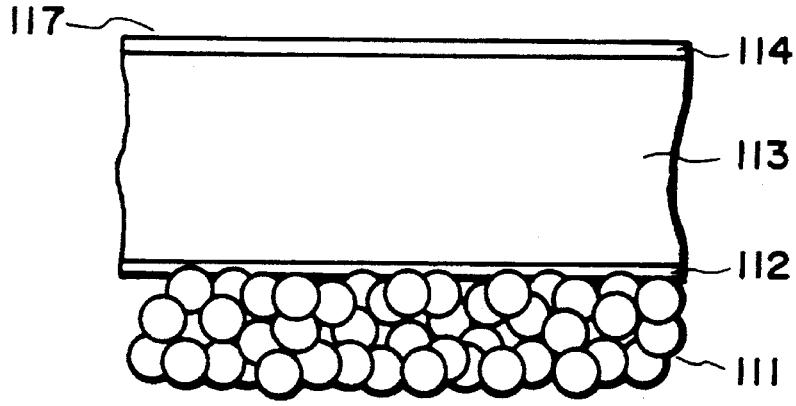
FIG. 16 is a sectional view of a transparent film according to the invention used in Example 14.

FIG. 16 is a sectional view of such a transparent film 117. It is also proposed to coat the opaque mark 111 with a layer of alumina-based porous particles. The present invention may also be applied to such a transparent film 117.

EXAMPLE 15

Figure 17:
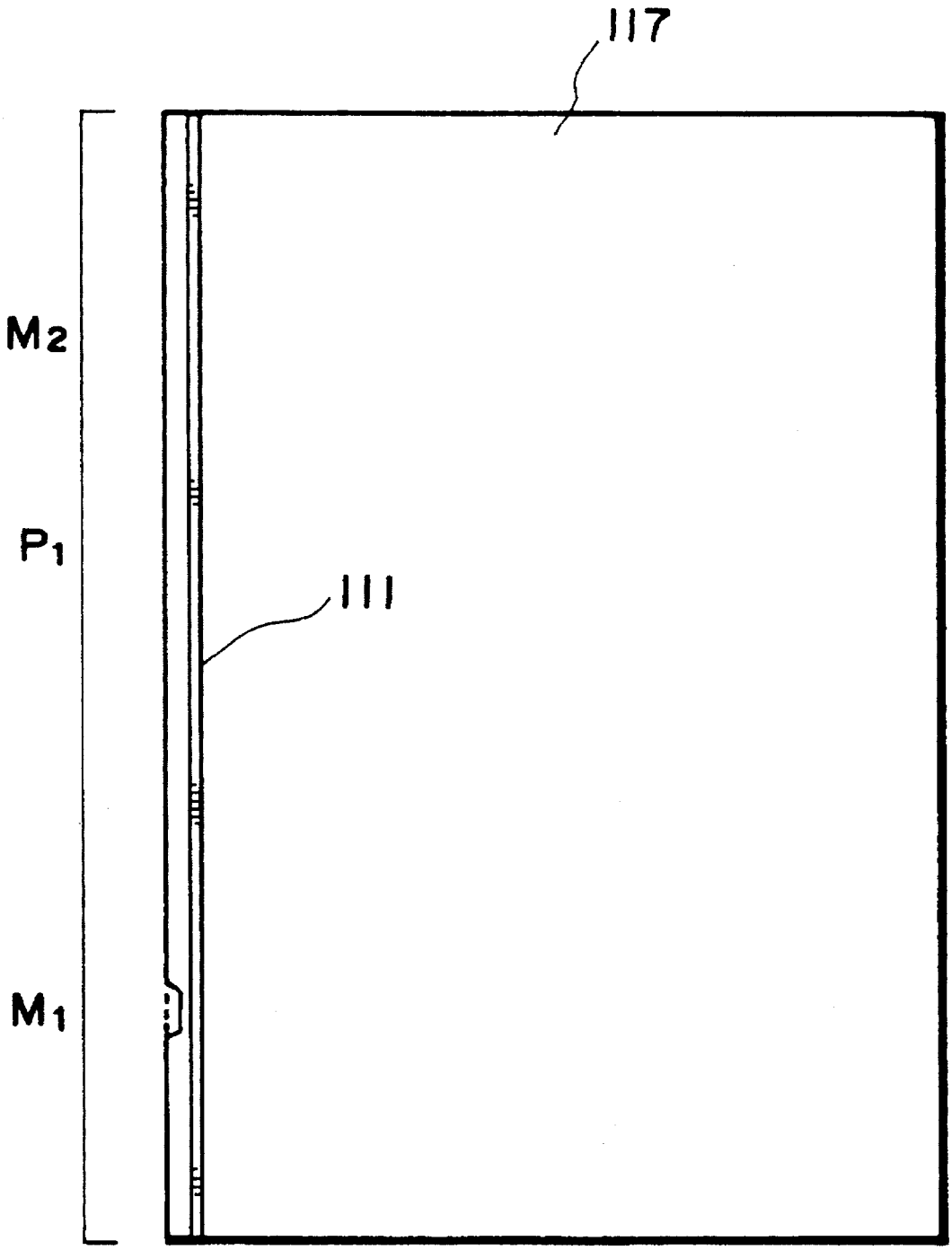
FIG. 17 is a top view for illustrating an operation in Example 15.

The detection of right or wrong side may be performed by using an opaque mark which is not asymmetrical as described above. FIG. 17 shows an example such a transparent film. Similarly as in FIG. 15, it is assumed that a main body of an image forming apparatus is disposed on a left side of FIG. 17, including one transmission-type optical sensor $P_1$ and two mechanical sensors $M_1$ and $M_2$. In this arrangement, the presence or absence of a recording medium 117 is detected by the optical sensor $P_1$, and the detection of right or wrong side is performed by the mechanical sensors $M_1$ and $M_2$.

In the above, the optical sensors have been explained as of the transmission-type but can also be of the reflection-type. The total number of the sensors need not be 3. For example, three sensors may be used as means for detecting the presence or absence of a recording medium including two mechanical sensors disposed on both sides of a recording medium for detecting the appropriateness of the size, or it is also possible to omit the detection of the presence or absence of a recording medium and substitute therefor the detection of right or wrong side.

EXAMPLE 16

In Examples 7–9, transparent films having an opaque mark having an initially random reflecting surface to be detected by an optical sensor and smoothed under heat and pressure formed or printed on a transparent sheet member 113. Such an opaque mark may be provided with not a reflecting surface but an internal random reflection layer which is clarified under heating. More specifically, it is possible to form a printed opaque layer by including within a print resin a low-molecular-weight organic compound, such as an organic acid, which is substantially incompatible with the print resin, thereby to form nuclei or a disperse phase of such an organic compound within the printed mark. Such nuclei become turbid when heated to and preferably maintained for about 10–30 sec at or above a certain temperature $S_1$, followed by cooling by standing at room temperature and become transparent when heated up to a temperature $S_2$ below $S_1$, followed by immediate cooling at room temperature. Suitable examples of the print resins used for this purpose may include polyester, polyvinyl chloride, vinyl chloride-vinyl acetate, vinyl acetate, vinyl chloride copolymer, and vinylidene chloride copolymer. Examples of the nuclei-forming compound may include: alkanol, alkanediol, halogen-alkanol, halogen-alkanediol, alkylamine, alkane, alkene, alkyne, halogen-alkane, halogen alkene, halogen-alkyne, cycloalkane, cycloalkene, cycloalkyne, saturated or unsaturated mono- or di-carboxylic acids or their esters, amides or ammonium salts, saturated or unsaturated halogen-aliphatic acids or their esters, amides or ammonium salts, aryl-carboxylic acids or their esters, amides or ammonium salts, halogen-aryl-carboxylic acids or their esters, amides or ammonium salts, thioalcohols, thiocarboxylic acids or their esters, amides or ammonium salts, carboxylic acid esters of thioalcohols, and mixtures of these compounds.

The paint for printing may be formed by mixing the monomer or prepolymer of a print resin as described above with a nucleic or disperse phase-forming compound as described above, and polymerizing the resultant mixture; or by forming a solution of a print resin and dispersing therein a nuclei-forming compound.

The print paint thus formed may be applied onto a desired part of a transparent sheet member 113 as used in Examples 7–9 and converted into a turbid state suitable for optical detection by heating above the temperature $S_1$.

In a specific example, a 30% THF-solution of vinylidene chloride-acrylonitrile copolymer and 5% THF-solution of docosanoic acid were mixed in a ratio of 1:1 and applied in a stripe onto a 100 μm-thick polyethylene terephthalate film as a sheet member 113, followed by drying to form a 10 μm-thick stripe. The resultant film was heated to 74° C., held at the temperature for 20 sec. and then cooled to room temperature by standing, whereby the coating stripe at the leading end of the film became white. The thus formed transparent film provided with an opaque printed mark was subjected to image formation and fixing in the same manner as in Example 4 except that the fixing speed was changed to 450 mm/sec, whereby the print mark on the product transparent film was made sufficiently clear for an OHP film.

The fixing speed may be lowered by covering the opaque paint mark with a 25 to 50 μm-thick polyester transparent film so as to insulate the print mark, whereby it becomes possible to change the temperature for clarification.

EXAMPLE 17

Figure 18:
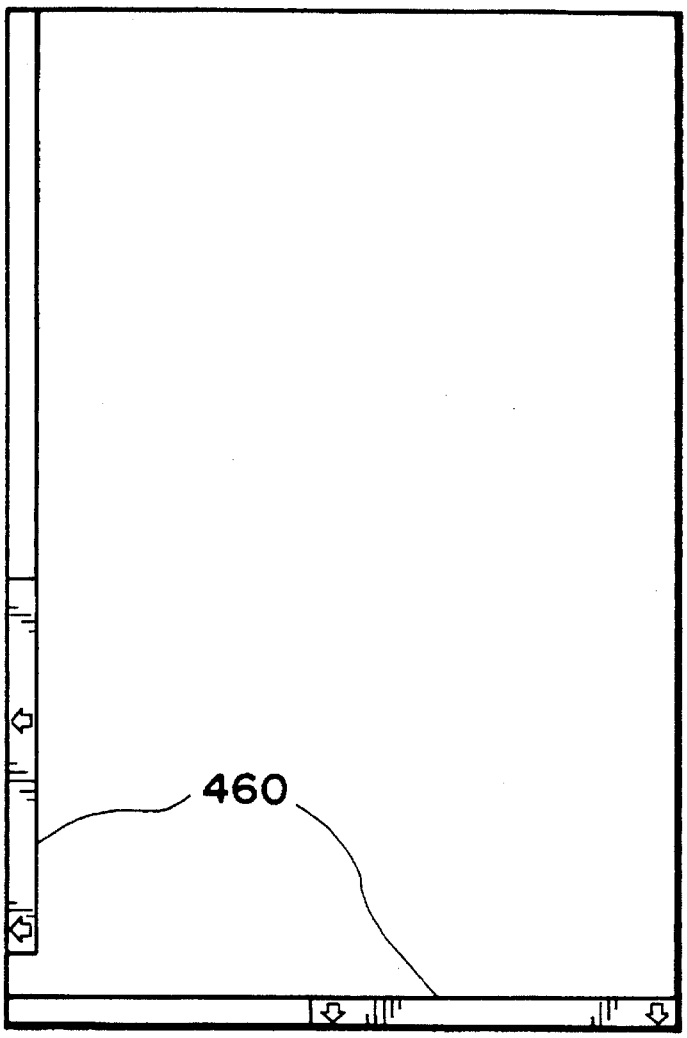
FIGS. 18 and 19 are a plan view and a sectional view, respectively, of a transparent film according to the invention used in Example 17.

FIG. 18 is a plan view of a transparent film according to this example. The transparent film was prepared by using a laminate film which in turn was formed by coating a biaxially stretched 100 μm-thick polyethylene terephthalate (PET) film having a heat-distortion temperature of 150° C. and usable up to 150° C. with an acetone solution of polyester resin (solubility parameter=about 11, storage modulus (G') at 160° C.=1000 dyne/cm$^2$, Ts (softening point)=116° C.) by using a bar coater, followed by drying to form a 16 μm-thick overcoat layer 442 on the PET film 441 as shown in FIG. 19.

Unlike the examples described up to now, in this example, an opaque mark for detection is formed without a coating or print layer. More specifically, a part 460 (FIG. 18) of the overcoat layer 442 (FIG. 19) of a laminate film formed in the above-described manner is matte-finished by roughening to an appropriate roughness, e.g., with a sandpaper to form an opaque part 460 which scatters and interrupts transmission of light incident thereto because of fine scars, thus functioning as an opaque mark for optical detection.

The roughness of the scars appropriate for the above purpose is such that the incident light is not allowed to pass through a pitch between scars and the scars do not exceed the thickness of the overcoat layer (16 μm in this example). Preferred ranges are that the scar pitch is at most 50 μm, and the surface roughness Rz is 1–10 μm, where an adequately low transmittance was confirmed to be accomplished.

Figure 28:
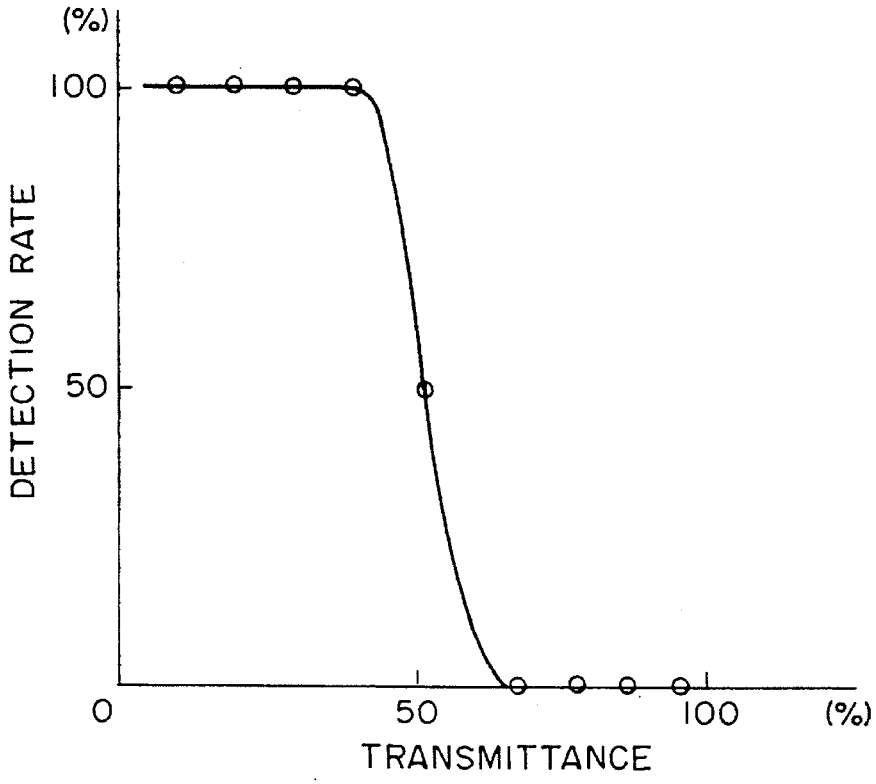
FIGS. 28 and 29 are respectively a graph showing a relationship between the detection rate and the transmittance of transparent films according to the invention.

When several transparent films having matte-finished opaque marks showing various roughnesses and thus different transmittances with respect to infrared rays of 800–1000 nm were supplied to a full-color image forming apparatus provided with a conventional optical detection system, whereby a relationship as shown in FIG. 28 was obtained between the right side-detection rate and the transmittance. More specifically, if the transmittance was in the range of 0–40%, i.e., 60–100% light interruption, the right face of the transparent film could be appropriately detected. If the transmittance was above 40%, the right-side of a transparent film was erroneously detected as the wrong side, thus showing an inapplicability.

Figure 33:
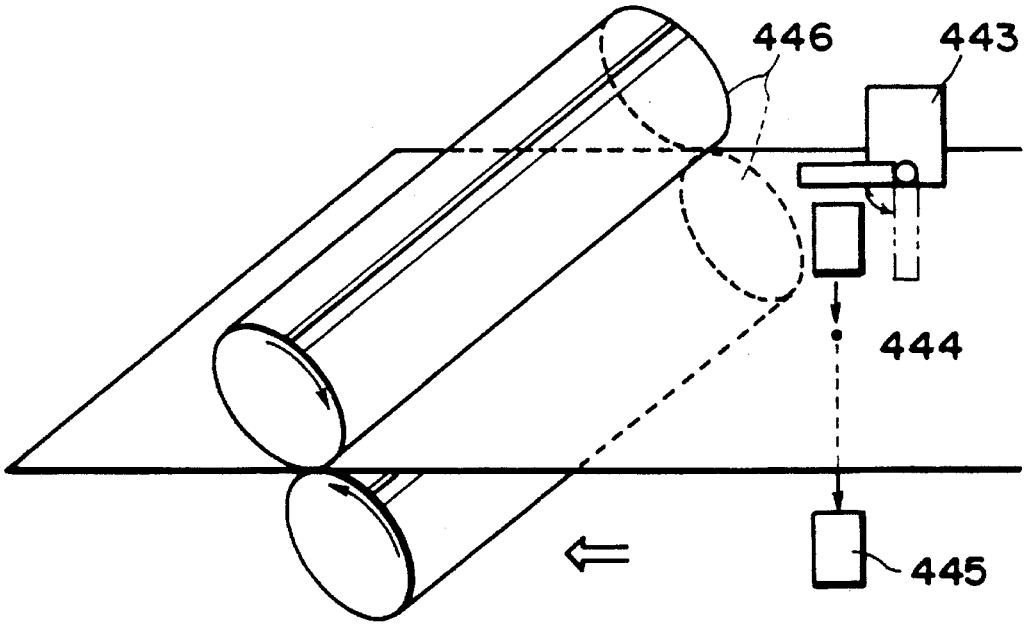
FIG. 33 PRIOR ART
FIG. 33 is an illustration of a detection means for detecting a transparent film.
Figure 34:
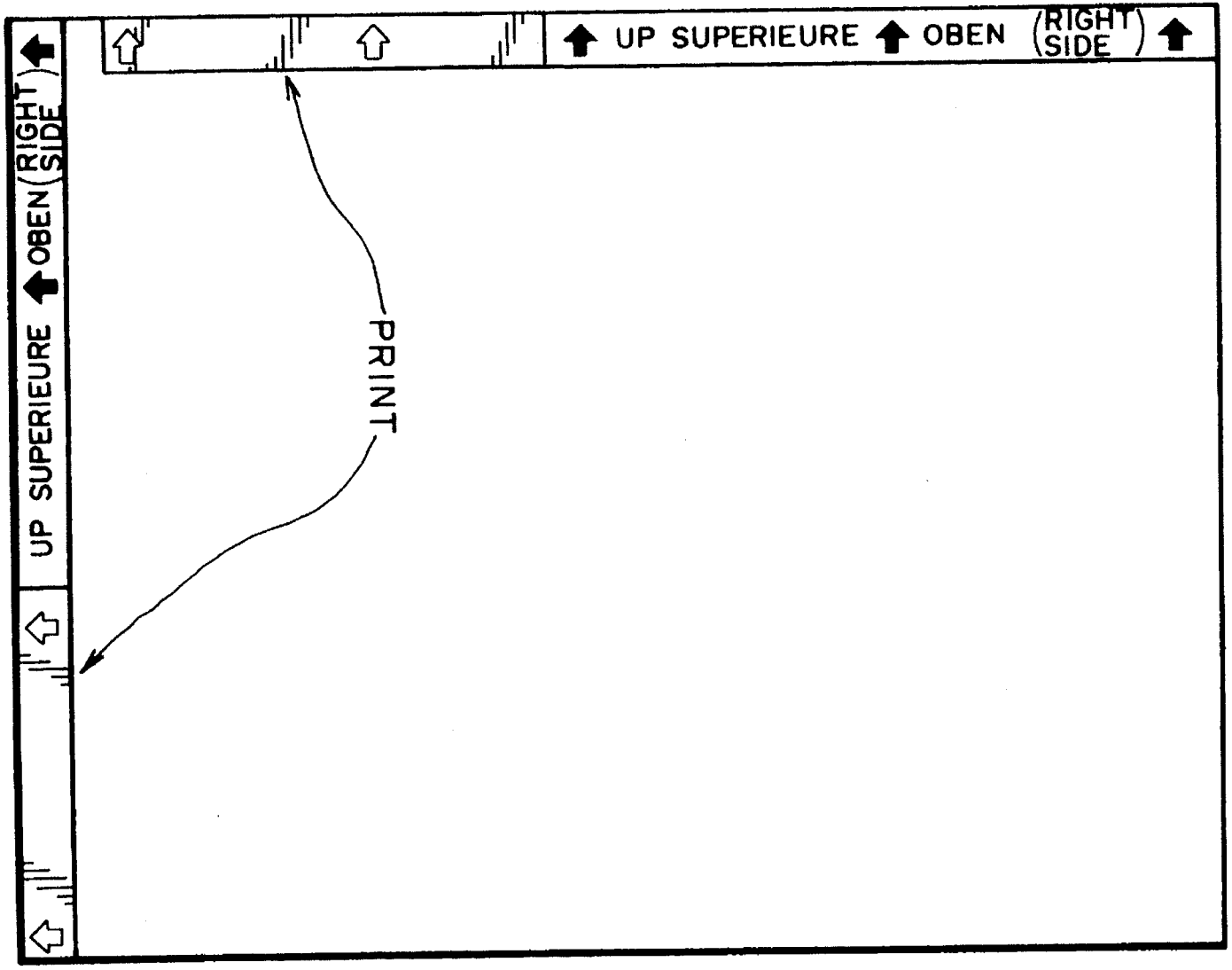
FIG. 34 PRIOR ART
FIG. 34 is a plan view of a conventional transparent film.
Figure 35:
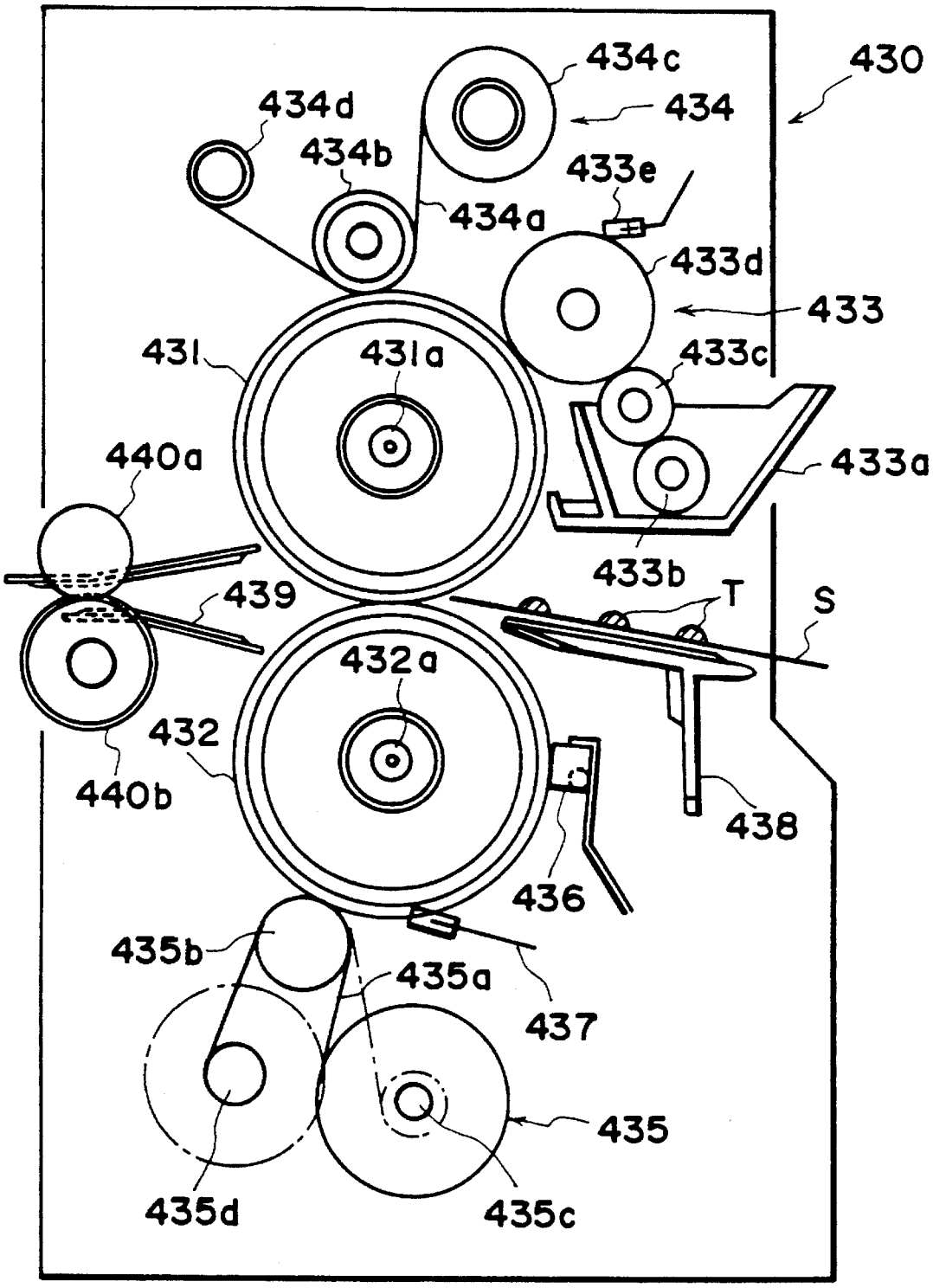
FIG. 35 PRIOR ART
FIG. 35 is an illustration of a roller-type fixing device.

Further, color image formation was performed on a transparent film by using a sharply melting toner comprising principally a polyester resin having a softening point of 105° C., and the resultant images were fixed in a fixing apparatus shown in FIG. 33.

In the case where the fixing roller surface temperature was 180° C., good images were obtained at a roller peripheral speed of 45 mm/sec for both the fixing and pressure rollers. In this instance, as the polyester resin constituting the overcoat layer 442 of the transparent laminate film had a softening point of 116° C., the matte-finished opaque marks 460 on the overcoat layer 442 were also softened similarly as the toner image and smoothed to be clarified and not recognizable.

Such a transparent film having a matte-finished opaque mark may be used also in an image forming apparatus as shown in FIG. 23 wherein a single photosensitive drum is used for plural times of image formation and transfer instead of the image forming apparatus using a recording medium-carrying belt used above, and also in a single transfer system using a black toner. The transparent film is also applicable to both analog and digital image formation.

EXAMPLE 18

In this example, a transparent laminate film was prepared by coating a PET film identical to the one used in Example 17 with a methyl ethyl ketone solution of an epoxy resin (solubility parameter=10.5, weight-average molecular weight=20000, G' at 160° C.=800 dyn/cm$^2$ Ts=114° C.) followed by drying to form a 15 μm-thick overcoat layer 442, which was then matte-finished similarly as in Example 17.

Figure 29:
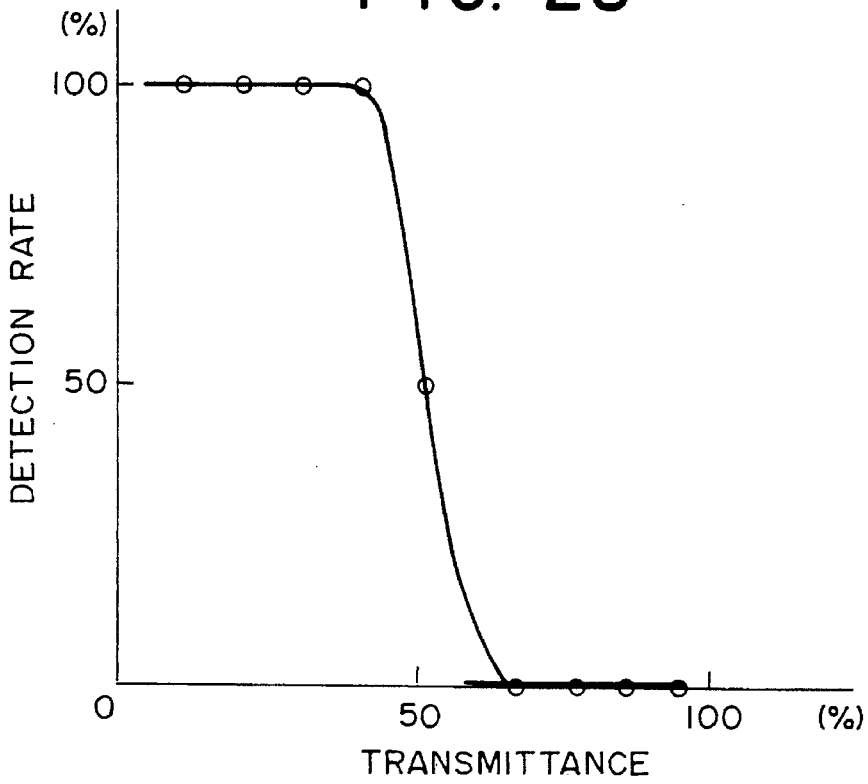

Several transparent films thus prepared having matte-finished opaque marks showing different transmittances with respect to infrared rays of 800–1000 nm were supplied to the image forming apparatus used in Example 17, whereby a relationship as shown in FIG. 29 similar to the one shown in FIG. 28 except for some differences negligible as experimental error was obtained between the right side-detection rate and the transmittance.

Further, color image formation was performed by using a toner identical to the toner used in Example 17 and the resultant toner images were fixed in the same fixing apparatus, whereby good images were obtained at a fixing roller surface temperature of 180° C. and a roller peripheral speed of 40 mm/sec for both the fixing and pressure rollers. After the fixing, the matted opaque marks were smoothed to be substantially unrecognizable similarly as in Example 17.

EXAMPLE 19

Figure 30:
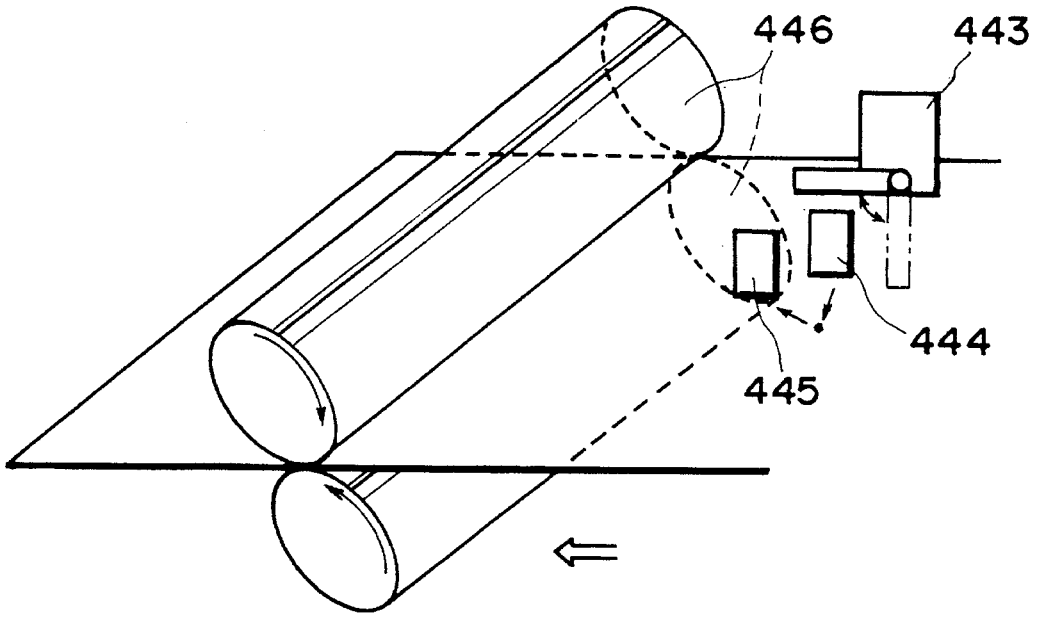
FIG. 30 is an illustration of a detection means for detecting a transparent film.

A transparent film as used in Examples 17 and 18 may be also applicable to detection by a reflection-type optical sensor as shown in FIG. 30. Referring to FIG. 30, the reflection-type sensor includes a light-emitting device 444 and a light-receiving device 445. Light from the light-emitting device 444 is incident to a recording medium, and the reflected light therefrom is received and detected by the light-receiving device 445.

Figure 31:
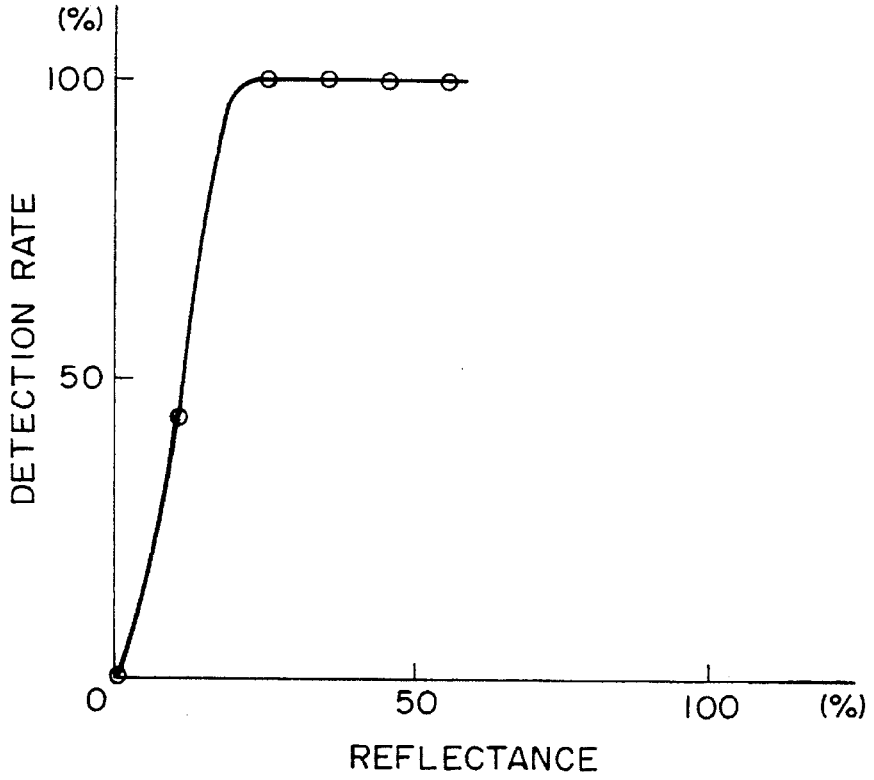
FIG. 31 is a graph showing a relationship between the detection rate and the transmittance of transparent films according to the invention.

When several transparent films having matte-finished opaque marks prepared similarly as in Examples 17 and 18 and showing different transmittances were supplied to a reflection-type optical sensor as shown in FIG. 30, a relationship as shown in FIG. 31 was obtained between the right side-detection rate and the reflectance. More specifically, a reflectance of 20% or higher allowed appropriate detection of the right side, whereas a reflectance below 20% caused an error of recognition as the wrong side.

Further, color image formation was performed by using a toner identical to those used in Examples 17 and 18, and the resultant toner images were fixed in a similar manner, whereby good images were obtained similarly. Further, after the fixing, the matted opaque marks were smoothed to be substantially unrecognizable similarly as in Examples 17 and 18.

EXAMPLE 20

Figure 32:
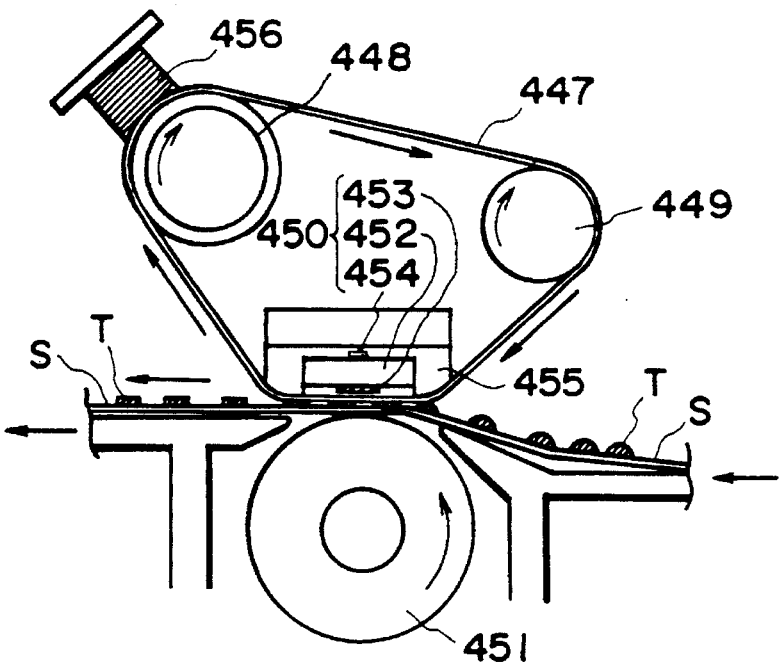
FIG. 32 is an illustration of a film-type fixing device.

A transparent film as used in Examples 17 and 18 may be also applicable to a film-type heat-fixing apparatus as shown in FIG. 32 after full-color image formation thereon.

Referring to FIG. 32, the fixing apparatus includes a heat-resistant fixing film 447 in the form of an endless belt, which is wound under tension about a left drive roller 448, a right following roller and mutually parallel three members 452, 453 and 454 of a low-heat capacity eating member 450 as a heating member disposed below the rollers 448 and 449.

The following roller 449 also functions as a tension roller for the fixing film 447 in the form of an endless belt. As a result, the fixing film 447 is driven in rotation without wrinkles, meandering or delayed movement in accompaniment with a clockwise rotation of the drive roller at a prescribed peripheral speed in the clockwise direction, i.e., at a speed equal to the conveying speed of a recording medium sheet S carrying an unfixed toner image T thereon supplied from an image forming section (not shown).

The fixing apparatus includes a pressure roller 451 having an elastomeric layer with a good releasability, such as a silicone rubber layer, which is pressed at a total abutting pressure of 4–7 kg against a lower side of the heating member 450 with a pressing member (not shown) so as to sandwich a portion of the endless fixing film 447 going downstream and rotates in a counterclockwise direction concurrent with the moving direction of the recording medium sheet S. The pressure roller 451 in this example comprises a core metal and a 7 mm-thick silicone rubber layer formed concentrically and integrally with the core metal so as to provide an outer diameter of 30 mm.

The heating member 450 is a low-heat capacity heating member longitudinally extending in a direction transverse to the planar movement direction of the fixing film (the width direction of the film) comprising a heater substrate 452, a current heat-generating resistor (heating element) 453 and a temperature-detecting device 454 and is affixed to and held by a heater support 455.

In such a heat-fixing apparatus as described above, a recording medium S carrying an un-fixed toner image thereon conveyed to between the fixing film 447 and the pressure roller 451 is subjected to fixing under heating by the heating member.

Figure 36:
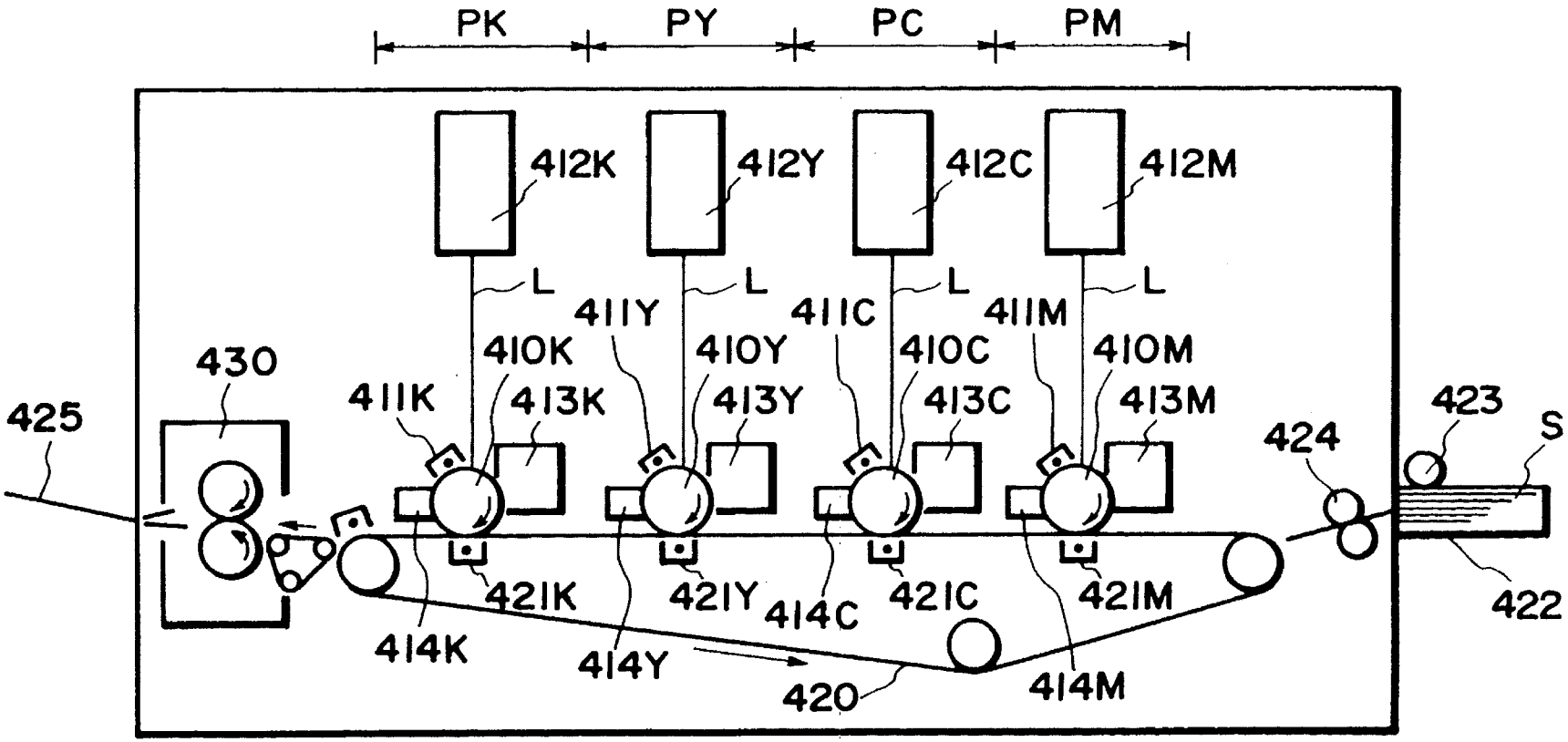
FIG. 36 PRIOR ART
FIG. 36 is an illustration of a conventional color image forming apparatus.

In an image forming apparatus provided with such a fixing apparatus constituted as described above otherwise as shown in FIG. 36, image formation was performed while performing the detection of a recording medium similarly as in Examples 17 and 18. In the fixing stage, good images were formed at a moving speed of 25 mm/sec of the fixing film at a temperature of 180° C. of the heating member 450, whereby the matted opaque marks for detection of the recording medium were smoothed to be unrecognizable similarly as in Example 17.

EXAMPLE 21

Both sides of a 100 μm-thick A4-size polyethylene terephthalate film ("Lumilar" (trade name), mfd. by Toray K.K.) were coated in a known manner respectively with a 5 μm-thick layer of water-soluble polyester resin containing silica and an anti-static agent so as to provide a surface sheet resistivity of $5\times10^{7}$–$5\times10^{10}$ Ω under conditions including a temperature of 20° C. and a moisture of 60% RH.

At the central part of the thus-coated film 100, an about 1 μm-thick opaque mark 102 as formed in a size of 5 cm×10 cm as shown in FIG. 2 by using a printing ink comprising a sublimation dye ("KAYAK", mfd. by Dai Nippon Kayaku K.K.) dispersed in a polyester resin.

The thus-obtained transparent film according to the present invention was used for image formation in a full-color electrophotographic apparatus shown in FIG. 21, whereby the conveyance state of the film in the apparatus was satisfactorily detected by random reflection light from the opaque mark.

Further, as a result of passing the transparent film through a heat-fixing device 29, the opaque mark 102 was sufficiently clarified due to sublimation of the dye therein at a fixing roller temperature of 180° C. and a heating time in the range of 50–200 msec.

EXAMPLE 22

A polyethylene terephthalate film identical to the one used in Example 21 was matte-finished and subjected to antistatic treatment to provide a base film.

Separately, a powdery hot-melt printing ink for providing an opaque mark was prepared by kneading a mixture of a compound ("IR 820B", mfd. by Showa Denko K.K.) represented by the following formula (1) and tetrabutylammonium butyltriphenyl borate in a mol ratio of 100:0.3 (a generally preferred range of 100:0.1–50) together with styrene resin.

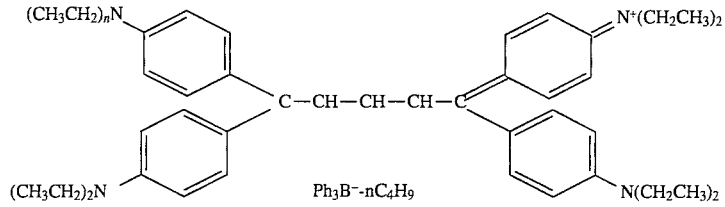

(1)

The powdery ink was applied by electrostatic coating onto the above-prepared base film, heated at 150° C. and slightly pressed to form a 65 μm-thick blue opaque mark.

The thus-prepared film with an opaque mark was supplied to a full-color electrophotographic apparatus as shown in FIG. 21 in which the light sources of the optical detection sensors 211*a*–211*c* had been changed into white tungsten lamps, whereby random reflection light was obtained so as to allow precise detection of the conveyance state of the film.

Further, the opaque mark of the film after image formation thereon was illuminated with light which had been emitted from a halogen lamp 213 for imagewise exposure, transmitted through a mirror 214 and condensed by a lens 212, whereby the blue opaque mark was decolored and made unnoticeable on the film carrying a fixed toner image after the fixing roller, thus providing a good full-color transparency film.

In the above instance, the light quantity for illumination from the halogen lamp 213 may be determined depending on the moving speed of the film but should be at least 0.2 $mW/cm^2$, preferably at least 1 $mW/cm^2$ as a sufficient amount.

EXAMPLE 23

A transparent film according to the present invention was prepared in the same manner as in Example 21 for using a powdery ink obtained by dispersing a mixture of a cationic dye of the following structural formula (2) instead of the compound ("IR 820B") and an organic boron ammonium salt in a mol ratio of 100:0.3 (a generally preferred range of 100:0.1–50) in styrene resin.

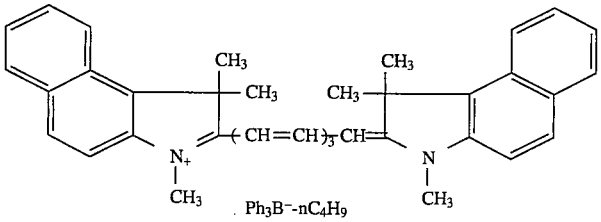

(2)

The thus-prepared film provided with an opaque mark was used for image formation in an apparatus as shown in FIG. 21. In this instance, the opaque mark could be decolored by using a near-infrared sensor (Ga—As—Al-based semiconductor laser) instead of the halogen lamp.

In recent years, digital copies using the semiconductor laser have been put on the market by many manufacturers, so that the above ink is practically more effective.

More specifically, for the decoloring, it is only necessary to use another exposure path than that for the image exposure so as to illuminate the opaque mark by disposing several swingable mirrors and shutters.

In such a system, the above laser may also be usable for adding characters or image data, if desired for detection, and for example, a frame of an OHP film can be easily made if the opaque mark is disposed on the entire area.

What is claimed is:

1. An image forming method, comprising:

providing a transparent film comprising an optically transparent sheet member having an opaque part;

forming an image on the transparent film; and clearing the opaque part by detaching the opaque part under heating, wherein the opaque part is held detachably under heating by the transparent sheet member with an adhesion-controlling layer disposed therebetween, the opaque part is detached under heating from the transparent sheet member by detaching means contacting the transparent film surface, and an adhesion A acting between the transparent sheet member and the adhesion-controlling layer, an adhesion B acting between the adhesion-controlling layer and the opaque part and an adhesion C acting between the opaque part and the detaching means satisfy a relationship of: adhesion A≦adhesion B<adhesion C.

2. A method according to claim 1, wherein the opaque part comprises a resin layer containing a pigment or dye dispersed therein and is detached under heating.

3. A method according to claim 1, wherein the opaque part comprises a metal foil and is detached under heating.

4. A method according to claim 1, wherein the opaque part comprises a porous resin layer and is detached under heating.

5. A method according to claim 4, wherein the opaque part comprises a resinous coating layer including resin or emulsion particles.

6. A method according to claim 5, wherein the opaque part comprises the resin or emulsion particles and a binder.

7. A method according to claim 1, wherein the adhesion-controlling layer functions to increase the adhesion between the opaque part and the transparent sheet member.

8. A method according to claim 1, wherein the adhesion-controlling layer functions to lower the adhesion between the opaque part and the transparent sheet member.

9. A method according to claim 1, wherein the opaque part is detached from the transparent sheet member by detaching means contacting and heating the transparent film surface.

10. A method according to claim 9, wherein the opaque part is detached from the transparent sheet member by a heated roller contacting the transparent film surface.

11. A method according to claim 10, wherein the heated roller is a fixing roller or a pressure roller constituting fixing means for fixing a toner image onto the transparent film.

12. A method according to claim 1, wherein the opaque part comprises resin or emulsion particles and a binder; and an adhesion A acting between the transparent sheet member and the adhesion-controlling layer, an adhesion B acting between the adhesion-controlling layer and the opaque part, an adhesion C acting between the opaque part and the detaching means and an adhesion D acting between the resin or emulsion particles satisfy a relationship of: adhesion A≦adhesion B<adhesion D<adhesion C.

13. A method according to claim 1, wherein the transparent film shows a surface resistivity of $5\times10^{7}$–$5\times10^{10}$ ohm at a temperature of 20° C. and a humidity of 60% RH.

14. A method according to claim 1, wherein the transparent film has a first surface for forming a toner image thereon, and the opaque part is formed on a second surface opposite to the first surface of the transparent film.

15. A method according to claim 1, wherein the transparent film has a first surface for forming a toner image thereon, and the opaque part is formed on the first surface of the transparent film.

16. A method according to claim 1, wherein the opaque part is detected by an amount of light transmitted therethrough or light reflected therefrom prior to the image formation.

17. A method according to claim 1, wherein the opaque part is detached by contact-heating means contacting and heating the transparent film surface.

18. A method according to claim 17, wherein the opaque part is detached by a heated roller contacting the transparent film surface.

19. A method according to claim 18, wherein the heated roller is a fixing roller or a pressure roller constituting fixing means for fixing a toner image onto the transparent film.

20. A method according to claim 1, wherein the opaque part functions as a detection mark for detecting a right side or a wrong side of the transparent sheet member, and the opaque part is optically detected prior to the image formation.

21. An image-forming method comprising:

providing a transparent film comprising an optically transparent sheet member having an opaque part;

forming an image on the transparent film; and clarifying the opaque part by heating, wherein the opaque part has been formed by toughening a part of the transparent film surface and is clarified by heating.

22. A method according to claim 21, wherein the transparent sheet member comprises a laminate structure including a first transparent resin layer comprising a heat-resistant resin and a second transparent resin layer comprising a transparent resin which has a solubility parameter of 9.5–12.5 and a storage modulus (G') at 160° C. of 100–10000 dyn/cm$^2$, and the opaque part has been formed by roughening the second resin layer and is clarified under heating.

23. A method according to claim 22, wherein the second transparent resin layer has been roughened to have fine scars at a pitch of at most 50 μm and a surface roughness (Rz) of 3–10 μm.

24. A method according to claim 22, wherein the opaque part shows a transmittance of at most 40% and a reflectance of at least 20% with respect to infrared rays at least in the range of 800–1000 nm.

25. A method according to claim 21, wherein the opaque part is clarified by contact-heating means contacting and heating the transparent film surface.

26. A method according to claim 25, wherein the opaque part is clarified by a heated roller contacting the transparent film surface.

27. A method according to claim 26, wherein the heated roller is a fixing roller or a pressure roller constituting fixing means for fixing a toner image onto the transparent film.

28. A method according to claim 25, wherein an adhesion between the transparent sheet member and the opaque part is larger than an adhesion between the opaque part and the contact-heating means.

29. A method according to claim 21, wherein the transparent film has a surface resistivity of $5\times10^7$–$5\times10^{10}$ ohm at a temperature of 20° C. and a humidity of 60% RH.

30. A method according to claim 21, wherein the transparent film has a first surface for forming a toner image thereon, and the opaque part is formed on a second surface opposite to the first surface of the transparent film.

31. A method according to claim 21, wherein the transparent film has a first surface for forming a toner image thereon, and the opaque part is formed on the first surface of the transparent film.

32. A method according to claim 21, wherein the opaque part is detected by an amount of light transmitted therethrough or light reflected therefrom prior to the image formation.

33. A method according to claim 21, wherein the opaque part functions as a detection mark for detecting a right side or a wrong side of the transparent sheet member, and the opaque part is optically detected prior to the image formation.

34. An image-forming method comprising;

providing a transparent film comprising an optically transparent sheet member and an opaque part locally formed on the transport sheet member;

forming a toner image on the transparent film; and wherein the opaque part comprises a resin layer of a porous structure formed on the optically transparent sheet member and a surface layer covering the resin layer.

35. A method according to claim 34, wherein the resin layer comprises resin particles or emulsion particles.

36. A method according to claim 31, wherein the resin layer comprises resin particles or emulsion particles and a binder.

37. A method according to claim 31, wherein the opaque part is held by the transparent sheet member with an adhesion-controlling layer disposed therebetween and is clarified by heating.

38. A method according to claim 27, wherein the adhesion-controlling layer functions to increase the adhesion between the opaque part and the transparent sheet member.

39. A method according to claim 31, wherein the transparent sheet member comprises a first resin having a softening temperature, and the opaque part comprises a second resin having a melting temperature lower than the softening temperature and is clarified by heating.

40. A method according to claim 34, wherein the porous structure includes internal cracks or communicating pores.

41. A method according to claim 34, wherein the surface layer is a layer for absorbing a release agent.

42. A method according to claim 34, wherein the opaque part is clarified by contact heating means contacting the transparent film surface.

43. A method according to claim 42, wherein the opaque part is clarified by a heated roller contacting the transparent film surface.

44. A method according to claim 43, wherein the heated roller is a fixing roller or a pressure roller constituting fixing means for fixing a toner image onto the transparent film.

45. A method according to claim 34, wherein the transparent film has a surface resistivity of $5\times10^7$–$5\times10^{10}$ ohm at a temperature of 20° C. and a humidity of 60% RH.

46. A method according to claim 34, wherein the transparent film has a first surface for forming a toner image thereon, and the opaque part is formed on a second surface opposite to the first surface of the transparent film.

47. A method according to claim 34, wherein the transparent film has a first surface for forming a toner image thereon, and the opaque part is formed on the first surface of the transparent film.

48. A method according to claim 34, wherein the opaque part is detected by an amount of light transmitted therethrough or light reflected therefrom prior to the image formation.

49. A method according to claim 34, wherein the opaque part functions as a detection mark for detecting a right side or a wrong side of the transparent sheet member, and the opaque part is optically detected prior to the image formation.

50. A method according to claim 34, wherein the opaque part is clarified under application of heat and pressure for fixing the toner image.

51. An image forming method according to claim 34, wherein the opaque part comprises a porous resin layer causing random reflection of light incident thereto and is clarified by softening under heating to form a smooth layer having no random reflectivity.

52. An image-forming method comprising:

providing a transparent film comprising an optically transparent sheet member having an opaque part;

forming an image on the transparent film; and clarifying the opaque part by heating wherein the opaque part has been formed by coloring with a sublimation dye and is clarified by heating to cause decoloration due to sublimation of the dye.

53. A method according to claim 52, wherein the transparent film has a surface resistivity of $5\times10^7$–$5\times10^{10}$ ohm at a temperature of 20° C. and a humidity of 60% RH.

54. A method according to claim 52, wherein the transparent film has a first surface for forming a toner image thereon, and the opaque part is formed on a second surface opposite to the first surface of the transparent film.

55. A method according to claim 52, wherein the transparent film has a first surface for forming a toner image thereon, and the opaque part is formed on the first surface of the transparent film.

56. A method according to claim 52, wherein the opaque part is detected by an amount of light transmitted therethrough or light reflected therefrom prior to the image formation.

57. A method according to claim 52, wherein the opaque part functions as a detection mark for detecting a right side or a wrong side of the transparent sheet member, and the opaque part is optically detected prior to the image formation.

58. An image-forming method comprising:

providing a transparent film comprising an optically transparent sheet member having an opaque part;

forming an image on the transparent film; and clarifying the opaque part by light illumination, wherein the opaque part has been formed by coloring with a cationic dye and is clarified by causing decoloration due to structural change of the dye.

59. A method according to claim 58, wherein the cationic dye comprises a compound represented by the following formula (1):

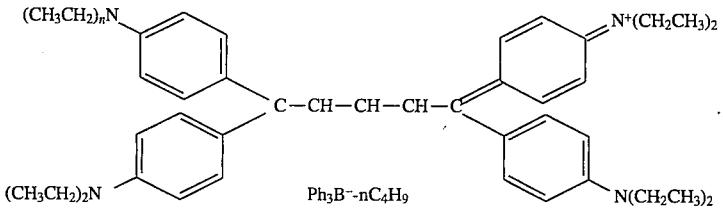

(1)

60. A method according to claim 58, wherein the cationic dye comprises a compound represented by the following formula (2):

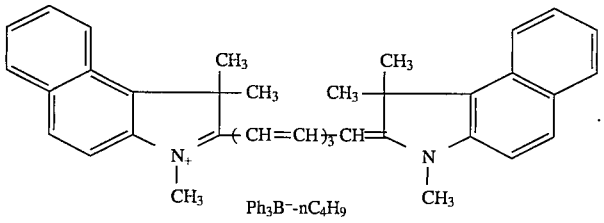

(2)

61. A method according to claim 58, wherein the transparent film has a surface resistivity of $5\times10^{7}$–$5\times10^{10}$ ohm at a temperature of 20° C. and a humidity of 60% RH.

62. A method according to claim 58, wherein the transparent film has a first surface for forming a toner image thereon, and the opaque part is formed on a second surface opposite to the first surface of the transparent film.

63. A method according to claim 58, wherein the transparent film has a first surface for forming a toner image thereon, and the opaque part is formed on the first surface of the transparent film.

64. A method according to claim 58, wherein the opaque part is detected by an amount of light transmitted therethrough or light reflected therefrom prior to the image formation.

65. A method according to claim 58, wherein the opaque part functions as a detection mark for detecting a right side or a wrong side of the transparent sheet member, and the opaque part is optically detected prior to the image formation.

66. An image forming apparatus, comprising:

image forming means for forming an image on a surface of a transparent film comprising an optically transparent sheet member having an opaque part;

wherein the opaque part is held detachably under heating by the transparent sheet member with an adhesion-controlling layer disposed therebetween;

and means for clearing the opaque part by detaching the opaque part under heating, said means comprising a detaching means which is abutted under heating to the transparent film surface to detach the opaque part from the transparent sheet member.

67. An apparatus according to claim 66, wherein the opaque part comprises a resin layer containing a pigment or dye dispersed therein and is detached under heating.

68. An apparatus according to claim 66, wherein the opaque part comprises a metal foil and is detached under heating.

69. An apparatus according to claim 66, wherein the opaque part comprises a porous resin layer and is detached under heating by detaching means.

70. An apparatus according to claim 69, wherein the opaque part comprises a resinous coating layer including resin or emulsion particles.

71. An apparatus according to claim 70, wherein the opaque part comprises the resin or emulsion particles and a binder.

72. An apparatus according to claim 66, wherein the adhesion-controlling layer functions to increase the adhesion between the opaque part and the transparent sheet member.

73. An apparatus according to claim 66, wherein the adhesion-controlling layer functions to lower the adhesion between the opaque part and the transparent sheet member.

74. An apparatus according to claim 66, wherein the opaque part is detached from the transparent sheet member by detaching means contacting and heating the transparent film surface.

75. An apparatus according to claim 74, wherein the opaque part is detached from the transparent sheet member by a heated roller contacting the transparent film surface.

76. An apparatus according to claim 75, wherein the heated roller is a fixing roller or a pressure roller constituting fixing means for fixing a toner image onto the transparent film.

77. An apparatus according to claim 66, wherein; an adhesion A acting between the transparent sheet member and the adhesion-controlling layer, an adhesion B acting between the adhesion-controlling layer and the opaque part and an adhesion C acting between the opaque part and the detaching means satisfy a relationship of: adhesion A≦adhesion B<adhesion C.

78. An apparatus according to claim 77, wherein the opaque part comprises resin or emulsion particles and a binder; and an adhesion A acting between the transparent sheet member and the adhesion-controlling layer, an adhesion B acting between the adhesion-controlling layer and the opaque part, an adhesion C acting between the opaque part and the detaching means and an adhesion D acting between the resin or emulsion particles satisfy a relationship of: adhesion A≦adhesion B<adhesion D<adhesion C.

79. An apparatus according to claim 66, wherein the transparent film shows a surface resistivity of $5\times10^7$–$5\times10^{10}$ ohm at a temperature of 20° C. and a humidity of 60% RH.

80. An apparatus according to claim 66, wherein the transparent film has a first surface for forming a toner image thereon, and the opaque part is formed on a second surface opposite to the first surface of the transparent film.

81. An apparatus according to claim 66, wherein the transparent film has a first surface for forming a toner image thereon, and the opaque part is formed on the first surface of the transparent film.

82. An apparatus according to claim 66, further comprising detection means for optically detecting the opaque part of the transparent film by reading an amount of light transmitted through or light reflected from the opaque part.

83. An apparatus according to claim 66, wherein the opaque part is detached by contact-heating means contacting and heating the transparent film surface.

84. An apparatus according to claim 83, wherein the opaque part is detached by a heated roller contacting the transparent film surface.

85. An apparatus according to claim 84, wherein the heated roller is a fixing roller or a pressure roller constituting fixing means for fixing a toner image onto the transparent film.

86. An apparatus according to claim 66, further comprising detection means for optically detecting the opaque part of the transparent film, wherein the opaque part functions as a detection mark for detecting a right side or a wrong side of the transparent sheet member.

87. An image-forming apparatus comprising:

image forming means for forming an image on a surface of a transparent film comprising an optically transparent sheet member having an opaque part; and means for clarifying the opaque part by heating, wherein the opaque part has been formed by roughening a part of the transparent film surface and is clarified by heating by clarifying means.

88. An image-forming apparatus according to claim 87, wherein the transparent sheet member comprises a laminate structure including a first transparent resin layer comprising a heat-resistant resin and a second transparent resin layer comprising a transparent resin which has a solubility parameter of 9.5–12.5 and a storage modulus (G') at 160° C. of 100–10000 dyn/cm$^2$, and the opaque part has been formed by roughening the second resin layer and is clarified under heating by clarifying means.

89. An apparatus according to claim 88, wherein the second transparent resin layer has been roughened to have fine scars at a pitch of at most 50 μm and a surface roughness (Rz) of 3–10 μm.

90. An apparatus according to claim 88, wherein the opaque part shows a transmittance of at most 40% and a reflectance of at least 20% with respect to infrared rays at least in the range of 800–1000 nm.

91. An apparatus according to claim 87, wherein the opaque part is clarified by contact-heating means contacting and heating the transparent film surface.

92. An apparatus according to claim 91, wherein the opaque part is clarified by a heated roller contacting the transparent film surface.

93. An apparatus according to claim 92, wherein the heated roller is a fixing roller or a pressure roller constituting fixing means for fixing a toner image onto the transparent film.

94. An apparatus according to claim 91, wherein an adhesion between the transparent sheet member and the opaque part is larger than an adhesion between the opaque part and the contact-heating means.

95. An apparatus according to claim 87, wherein the transparent film has a surface resistivity of $5\times10^7$–$5\times10^{10}$ ohm at a temperature of 20° C. and a humidity of 60% RH.

96. An apparatus according to claim 87, wherein the transparent film has a first surface for forming a toner image thereon, and the opaque part is formed on a second surface opposite to the first surface of the transparent film.

97. An apparatus according to claim 87, wherein the transparent film has a first surface for forming a toner image thereon, and the opaque part is formed on the first surface of the transparent film.

98. An apparatus according to claim 87, further comprising detection means for optically detecting the opaque part of the transparent film by reading an amount of light transmitted through or light reflected from the opaque part.

99. An apparatus according to claim 87, further comprising detection means for optically detecting the opaque part of the transparent film wherein the opaque part functions as a detection mark for detecting a right side or a wrong side of the transparent sheet member.

100. An image-forming apparatus comprising:

image forming means for forming a toner image on a surface of a transparent film comprising an optically transparent sheet member and an opaque part locally formed on the transparent sheet member; and means for clarifying the opaque part by heating, wherein the opaque part comprises a resin layer of a porous structure formed on the optically transparent sheet member and a surface layer covering the resin layer.

101. An image-forming apparatus according to claim 100, wherein the resin layer comprises resin particles or emulsion particles.

102. An image-forming apparatus according to claim 101, wherein the resin layer comprises resin particles or emulsion particles and a binder.

103. An apparatus according to claim 100, wherein the opaque part is held by the transparent sheet member with an adhesion-controlling layer disposed therebetween and is clarified by heating.

104. An apparatus according to claim 103, wherein the adhesion-controlling layer functions to increase the adhesion between the opaque part and the transparent sheet member.

105. An apparatus according to claim 100, wherein the transparent sheet member comprises a first resin having a softening temperature, and the opaque part comprises a second resin having a melting temperature lower than the softening temperature and is clarified by heating by clarifying means.

106. An apparatus according to claim 100, wherein the porous structure include internal cracks of communicating pores.

107. An apparatus according to claim 100, wherein the surface layer is a layer for absorbing a release agent.

108. An apparatus according to claim 100, wherein the opaque part is clarified by contact-heating means contacting and heating the transparent film surface.

109. An apparatus according to claim 108, wherein the opaque part is clarified by a heated roller contacting the transparent film surface.

110. An apparatus according to claim 109, wherein the heated roller is a fixing roller or a pressure roller constituting fixing means for fixing a toner image onto the transparent film.

111. An apparatus according to claim 100, wherein the transparent film has a surface resistivity of $5\times10^{7}$–$5\times10^{10}$ ohm at a temperature of 20° C. and a humidity of 60% RH.

112. An apparatus according to claim 100, wherein the transparent film has a first surface for forming a toner image thereon, and the opaque part is formed on a second surface opposite to the first surface of the transparent film.

113. An apparatus according to claim 100, wherein the transparent film has a first surface for forming a toner image thereon, and the opaque part is formed on the first surface of the transparent film.

114. An apparatus according to claim 100, further comprising detection means for optically detecting the opaque part of the transparent film by reading an amount of light transmitted through or light reflected from the opaque part.

115. An apparatus according to claim 100, further comprising detection means for optically detecting the opaque part of the transparent film, wherein the opaque part functions as a detection mark for detecting a right side or a wrong side of the transparent sheet member.

116. An apparatus according to claim 100, wherein the means for clearing the opaque part comprises means for applying heat and pressure for fixing the toner image.

117. An image forming method according to claim 100, wherein the opaque part comprises a porous resin layer causing random reflection of light incident thereto and is clarified by softening under heating to form a smooth layer having no random reflectivity.

118. An image-forming apparatus comprising:

image forming means for forming an image on a surface of a transparent film comprising an optically transparent sheet member having an opaque part; and means for clarifying the opaque part by heating, wherein the opaque part has been formed by coloring with a sublimation dye and is clarified by heating by clarifying means to cause decoloration due to sublimation of the dye.

119. An apparatus according to claim 118, wherein the opaque part is clarified by contact-heating means contacting and heating the transparent film surface.

120. An apparatus according to claim 119, wherein the opaque part is clarified by a heated roller contacting the transparent film surface.

121. An apparatus according to claim 120, wherein the heated roller is a fixing roller or a pressure roller constituting fixing means for fixing a toner image onto the transparent film.

122. An apparatus according to claim 118, wherein the transparent film has a surface resistivity of $5\times10^{7}$–$5\times10^{10}$ ohm at a temperature of 20° C. and a humidity of 60% RH.

123. An apparatus according to claim 118, wherein the transparent film has a first surface for forming a toner image thereon, and the opaque part is formed on a second surface opposite to the first surface of the transparent film.

124. An apparatus according to claim 118, wherein the transparent film has a first surface for forming a toner image thereon, and the opaque part is formed on the first surface of the transparent film.

125. An apparatus according to claim 118, further comprising detection means for optically detecting the opaque part of the transparent film by reading an amount of light transmitted through a light reflected from the opaque part.

126. An apparatus according to claim 118, further comprising detection means for optically detecting the opaque part of the transparent film, wherein the opaque part functions as a detection mark for detecting a right side or a wrong side of the transparent sheet member.

127. An image-forming apparatus comprising:

image forming means for forming an image on a surface of a transparent film comprising an optically transparent sheet member having an opaque part; and means for clarifying the opaque part by light illumination, wherein the opaque part has been formed by coloring with a cationic dye and is clarified by light illumination to cause decoloration due to structural change of the dye.

128. An apparatus according to claim 127, wherein the cationic dye comprises a compound represented by the following formula (1):

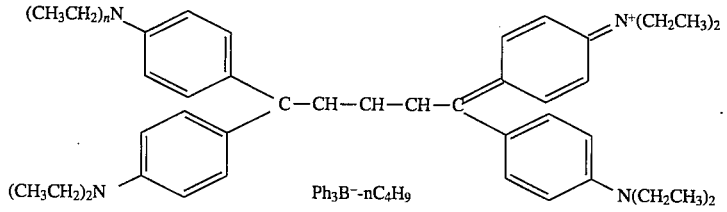

(1)

129. An apparatus according to claim 127, wherein the cationic dye comprises a compound represented by the following formula (2):

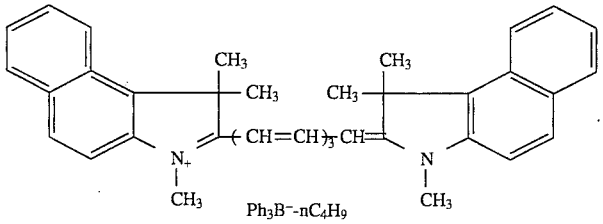

(2)

130. An apparatus according to claim 127, wherein the means for clarifying the opaque part comprises a halogen lamp.

131. An apparatus according to claim 127, wherein the means for clarifying the opaque part comprises a semiconductor laser.

132. An apparatus according to claim 127, wherein the transparent film has a surface resistivity of $5\times10^{7}$–$5\times10^{10}$ ohm at a temperature of 20° C. and a humidity of 60% RH.

133. An apparatus according to claim 127, wherein the transparent film has a first surface for forming a toner image thereon, and the opaque part is formed on a second surface opposite to the first surface of the transparent film.

134. An apparatus according to claim 127, wherein the transparent film has a first surface for forming a toner image thereon, and the opaque part is formed on the first surface of the transparent film.

135. An apparatus according to claim 127, further comprising detection means for optically detecting the opaque part of the transparent film by reading an amount of light transmitted through or light reflected from the opaque part.

136. A apparatus according to claim 127, further comprising detection means for optically detecting the opaque part of the transparent film wherein the opaque part functions as a detection mark for detecting a right side or a wrong side of the transparent sheet member.

137. A transparent film, comprising: an optically transparent sheet member having an opaque part to be detached under heating from the transparent sheet member, wherein the opaque part is held detachably under heating by the transparent sheet member with an adhesion-controlling layer disposed therebetween, the opaque part is detached under heating from the transparent sheet member by detaching means contacting the transparent film surface and an adhesion A acting between the transparent sheet member and the adhesion controlling layer, and adhesion B acting between the adhesion-controlling layer an the opaque part and an adhesion C acting between the opaque part and the detaching means satisfy a relationship of: adhesion A≦adhesion B, adhesion<C.

138. A transparent film according to claim 137, wherein the opaque part comprises a resin layer containing a pigment or dye dispersed therein.

139. A transparent film according to claim 137, wherein the opaque part comprises a metal foil.

140. A transparent film according to claim 137, wherein the opaque part comprises a porous resin layer.

141. A transparent film according to claim 140, wherein the opaque part comprises a resinous coating layer including resin or emulsion particles.

142. A transparent film according to claim 141, wherein the opaque part comprises the resin or emulsion particles and a binder.

143. A transparent film according to claim 137, wherein the adhesion-controlling layer functions to lower the adhesion between the opaque part and the transparent sheet member.

144. A transparent film according to claim 137, wherein the opaque part is detached from the transparent sheet member by detaching means contacting and heating the transparent film surface.

145. A transparent film according to claim 144, wherein the opaque part is detached from the transparent sheet member by a heated roller contacting the transparent film surface.

146. A transparent film according to claim 145, wherein the heated roller is a fixing roller or a pressure roller constituting fixing means for fixing a toner image onto the transparent film.

147. A transparent film according to claim 137, wherein the opaque part comprises resin or emulsion particles and a binder; the opaque part is detached from the transparent sheet member by detaching means contacting and heating the transparent film surface; and an adhesion A acting between the transparent sheet member and the adhesion-controlling layer, an adhesion B acting between the adhesion-controlling layer and the opaque part, an adhesion C acting between the opaque part and the detaching means and an adhesion D acting between the resin or emulsion particles satisfying a relationship of: adhesion A≦adhesion B<adhesion D<adhesion C.

148. A transparent film according to claim 137, wherein the transparent film has a first surface for forming a toner image thereon, and the opaque part is formed on a second surface opposite to the first surface of the transparent film.

149. A transparent film according to claim 137, wherein the transparent film has a surface resistivity of $5\times10^{7}$–$5\times10^{10}$ ohm at a temperature of 20° C. and a humidity of 60% RH.

150. A transparent film according to claim 137, wherein the transparent film has a first surface for forming a toner image thereon, and the opaque part is formed on the first surface of the transparent film.

151. A transparent film according to claim 137, wherein the opaque part is detached by contact-heating means contacting and heating the transparent film surface.

152. A transparent film according to claim 151, wherein the opaque part is detached by a heated roller contacting the transparent film surface.

153. A transparent film according to claim 152, wherein the heated roller is a fixing roller or a pressure roller constituting fixing means for fixing a toner image onto the transparent film.

154. A transparent sheet according to claim 137, wherein the opaque part functions as a detection mark for detecting a right side or a wrong side of the transparent sheet member.

155. A transparent film according to claim 137, wherein the adhesion-controlling layer functions to increase the adhesion between the opaque part and the transparent sheet member.

156. A transparent film comprising:

an optically transparent sheet member having an opaque part to be clarified by heating, Wherein the opaque part has been formed by roughening a part of the transparent film surface.

157. A transparent film according to claim 156, wherein the transparent sheet member comprises a laminate structure including a first transparent resin layer comprising a heat-resistant resin and a second transparent resin layer comprising a transparent resin which has a solubility parameter of 9.5–12.5 and a storage modulus (G') at 160° C. of 100–10000 dyn/cm$^2$, and the opaque part has been formed by roughening the second resin layer and is clarified under heating.

158. A transparent film according to claim 157, wherein the second transparent resin layer has been roughened to have fine scars at a pitch of at most 50 μm and a surface roughness (Rz) of 3–10 μm.

159. A transparent film according to claim 157, wherein the opaque part shows a transmittance of at most 40% and a reflectance of at least 20% with respect to infrared rays at least in the range of 800–1000 nm.

160. A transparent film according to claim 156, wherein the transparent film has a surface resistivity of $5\times10^7$–$5\times10^{10}$ ohm at a temperature of 20° C. and a humidity of 60% RH.

161. A transparent film according to claim 156, wherein the transparent film has a first surface for forming a tone image thereon, and the opaque part is formed on a second surface opposite to the first surface of the transparent film.

162. A transparent film according to claim 156, wherein the transparent film has a first surface for forming a toner image thereon, and the opaque part is formed on the first surface of the transparent film.

163. A transparent film according to claim 156, wherein the opaque part is clarified by contact-heating mean contacting and heating the transparent film surface.

164. A transparent film according to claim 163, wherein the opaque part is clarified by a heated roller contacting the transparent film surface.

165. A transparent film according to claim 164, wherein the heated roller is a fixing roller or a pressure roller constituting fixing means for fixing a toner image onto the transparent film.

166. A transparent sheet according to claim 156, wherein the opaque part functions as a detection mark for detecting a right side or a wrong side of the transparent sheet member.

167. A transparent film for electrophotography comprising:

an optically transparent sheet member and an opaque part locally formed on the optically transparent sheet member, said opaque part to be clarified by heating;

wherein the opaque part comprises a resin layer of a porous structure formed on the optically transparent sheet member and a surface layer covering the resin layer.

168. A transparent film according to claim 167, wherein the resin layer comprises resin particles or emulsion particles.

169. A transparent film according to claim 167, wherein the resin layer comprises resin particles or emulsion particles and a binder.

170. A transparent film according to claim 167, wherein the opaque part is held by the transparent sheet member with an adhesion-controlling layer disposed therebetween.

171. A transparent film according to claim 170, wherein the adhesion-controlling layer functions to increase the adhesion between the opaque part and the transparent sheet member.

172. A transparent film according to claim 170, wherein an adhesion between the transparent sheet member and the opaque part is larger than an adhesion between the opaque part and the contact-heating means.

173. A transparent film according to claim 167, wherein the transparent sheet member comprises a first resin having a softening temperature, and the opaque part comprises a second resin having a melting temperature lower than the softening temperature.

174. A transparent film according to claim 167, wherein the opaque part is clarified by contact-heating means contacting and heating the transparent film surface.

175. A transparent film according to claim 174, wherein the opaque part is clarified by a heated roller contacting the transparent film surface.

176. A transparent film according to claim 175, wherein the heated roller is a fixing roller or a pressure roller constituting fixing means for fixing a toner image onto the transparent film.

177. A transparent film according to claim 167, wherein the transparent film has a surface resistivity of $5\times10^7$–$5\times10^{10}$ ohm at a temperature of 20° C. and a humidity of 60% RH.

178. A transparent film according to claim 167, wherein the transparent film has a first surface for forming a toner image thereon, and the opaque part is formed on a second surface opposite to the first surface of the transparent film.

179. A transparent film according to claim 167, wherein the transparent film has a first surface for forming a toner image thereon, and the opaque part is formed on the first surface of the transparent film.

180. (Amended A transparent sheet according to claim 167, wherein the opaque part functions as a detection mark for detecting a right side or a wrong side of the transparent sheet member.

181. A transparent film according to claim 167, wherein the opaque part is clarified under application of heat and pressure for fixing a toner image onto the transparent film in electrophotography.

182. A transparent film according to claim 167, wherein the opaque part comprises a porous resin layer causing random reflection of light incident thereto and is clarified by softening under heating to form a smooth layer having no random reflectivity.

183. A transparent film comprising:

an optically transparent sheet member having an opaque part to be clarified by heating, wherein the opaque part has been formed by coloring with a sublimation dye and is clarified by heating to cause decoloration due to sublimation of the dye.

184. A transparent film according to claim 183, wherein the transparent film has a surface resistivity $5\times10^7$–$5\times10^{10}$ ohm at a temperature of 20° C. and a humidity of 60% RH.

185. A transparent film according to claim 183, wherein the transparent film has a first surface for forming a toner image thereon, an the opaque part is formed on a second surface opposite to the first surface of the transparent film.

186. A transparent film according to claim 183, wherein the transparent film ash a first surface for forming a toner image thereon, and the opaque part is formed on the first surface of the transparent film.

187. A transparent film according to claim 183, wherein the opaque part is clarified by contact-heating means contacting and heating the transparent film surface.

188. A transparent film according to claim 187, wherein the opaque part is clarified by a heated roller contacting the transparent film surface.

189. A transparent film according to claim 188, wherein the heated roller is a fixing roller or a pressure roller constituting fixing means for fixing a toner image onto the transparent film.

190. A transparent sheet according to claim 183, wherein the opaque part functions as a detection mark for detecting a right side or a wrong side of the transparent sheet member.

191. A transparent film comprising:

an optically transparent sheet member having an opaque part to be clarified by light illumination, wherein the opaque part has been formed by coloring with a cationic dye and is clarified by light illumination to cause decoloration due to structural change of the dye.

192. A transparent film according to claim 191, wherein the cationic dye comprises a compound represented by the following formula (1):

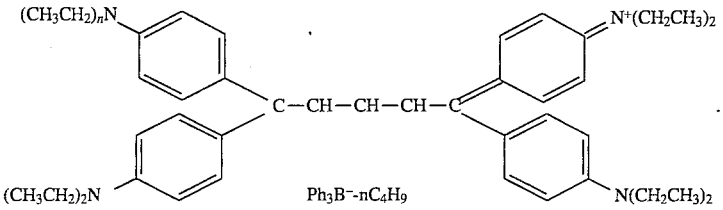

(1)

193. A transparent film according to claim 191, wherein the cationic dye comprises a compound represented by the following formula (2):

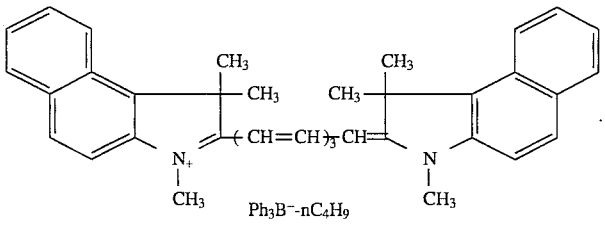

(2)

194. A transparent film according to claim 191, wherein the transparent film has a surface resistivity of $5\times10^{7}$–$5\times10^{10}$ ohm at a temperature of 20° C. and a humidity of 60% RH.

195. A transparent film according to claim 191, wherein the transparent film has a first surface for forming a toner image thereon, and the opaque part is formed on a second surface opposite to the first surface of the transparent film.

196. A transparent film according to claim 191, wherein the transparent film has a first surface for forming a toner image thereon, and the opaque part is formed on the first surface of the transparent film.

197. A transparent sheet according to claim 191, wherein the opaque part functions as a detection mark for detecting a right side or a wrong side of the transparent sheet member.

* * * * *

UNITED STATES PATENT AND TRADEMARK OFFICE

CERTIFICATE OF CORRECTION

PATENT NO. : 5,572,291

DATED : November 5, 1996

INVENTOR(S) : HARUHIKO MORIGUCHI ET AL.

It is certified that error appears in the above-identified patent and that said Letters Patent is hereby corrected as shown below:

Title page,
AT [56] REFERENCES CITED

Foreign Patent Documents,
"403311A3 12/1990 Euro. Pat. Office .... G03G 7/00"
(second occurrence) should be deleted.

COLUMN 2

Line 20, "provides" should read --provide--.

COLUMN 4

Line 18, "require" should read --requires--.

COLUMN 5

Line 13, "formation" should read --formation on--.
Line 49, "the" should be deleted.

COLUMN 6

Line 4, "portion;" should read --parts;--.

COLUMN 9

Line 35, "opaque mark 112" should read
--opaque mark 111--.

COLUMN 13

Line 26, "include" should read --includes--.

UNITED STATES PATENT AND TRADEMARK OFFICE

CERTIFICATE OF CORRECTION

PATENT NO. : 5,572,291

DATED : November 5, 1996

INVENTOR(S) : HARUHIKO MORIGUCHI ET AL.

It is certified that error appears in the above-identified patent and that said Letters Patent is hereby corrected as shown below:

COLUMN 14

Line 19, "member" should read --member 41a (similar to members 41b-41d)--.

COLUMN 20

Line 23 , "show" should read --shown--.
Line 36, "move" should read --move in--.

COLUMN 24

Line 7, "represent" should read --represented--.

COLUMN 25

Line 52, "example" should read --example of--.

COLUMN 26

Line 20, "sec" should read --sec.--.

COLUMN 29

Line 1, "eating" should read --heating--.

COLUMN 32

Line 65, "toughening" should read --roughening--.

UNITED STATES PATENT AND TRADEMARK OFFICE

CERTIFICATE OF CORRECTION

PATENT NO. : 5,572,291

DATED : November 5, 1996

INVENTOR(S) : HARUHIKO MORIGUCHI ET AL.

It is certified that error appears in the above-identified patent and that said Letters Patent is hereby corrected as shown below:

COLUMN 33

Line 49, "comprising;" should read --comprising:--.
Line 53, "transport" should read --transparent--;
Line 54, "and" should read --and ¶ clarifying the opaque part by heating;--.
Line 61, "claim 31," should read --claim 34,--.
Line 64, "claim 31," should read --claim 34,--.

COLUMN 34

Line 1, "claim 27," should read --claim 37,--.
Line 4, "claim 31," should read --claim 34,--.
Line 52, "heating" should read --heating,--.

COLUMN 36

Line 66, "wherein;" should read --wherein,--.

COLUMN 38

Line 66, "include" should read --includes--.

COLUMN 41

Line 46, "an" (first occurrence) should read --and--.
Line 49, "A≤ adhesion B, adhesion C." should read --A≤ adhesion B< adhesion C.--.

COLUMN 42

Line 62, "Wherein" should read --wherein--.

UNITED STATES PATENT AND TRADEMARK OFFICE

CERTIFICATE OF CORRECTION

PATENT NO. : 5,572,291

DATED : November 5, 1996

INVENTOR(S) : HARUHIKO MORIGUCHI ET AL. Page 4 of 4

It is certified that error appears in the above-identified patent and that said Letters Patent is hereby corrected as shown below:

COLUMN 43

Line 24, "mean" should read --means--.

COLUMN 44

Line 19, "(Amended" should be deleted.
Line 43, "an" should read --and--.
Line 45, "ash" should read --has--.

Signed and Sealed this

Third Day of June, 1997

*Attest:*

*Attesting Officer*

Bruce Lehman

BRUCE LEHMAN

*Commissioner of Patents and Trademarks*